US010591254B1

(12) United States Patent
Kenney

(10) Patent No.: US 10,591,254 B1
(45) Date of Patent: Mar. 17, 2020

(54) BALLISTIC WIND CORRECTION TO IMPROVE ARTILLERY ACCURACY

(71) Applicant: William Arthur Kenney, Spotsylvania, VA (US)

(72) Inventor: William Arthur Kenney, Spotsylvania, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 16/239,105

(22) Filed: Jan. 3, 2019

Related U.S. Application Data

(60) Provisional application No. 62/730,745, filed on Sep. 13, 2018.

(51) Int. Cl.

| | |
|---|---|
| ***G06G 7/80*** | (2006.01) |
| ***F41G 3/08*** | (2006.01) |
| ***F41G 3/10*** | (2006.01) |
| ***F41G 3/22*** | (2006.01) |

(52) U.S. Cl.
CPC ..... *F41G 3/08* (2013.01); *F41G 3/10* (2013.01); *F41G 3/22* (2013.01)

(58) Field of Classification Search
USPC ..... 235/404
See application file for complete search history.

(56) References Cited

U.S. PATENT DOCUMENTS

| | | | | |
|---|---|---|---|---|
| 9,010,002 | B2 | 4/2015 | Popa-Simil | 42/1.06 |
| 9,816,782 | B2 | 11/2017 | Maryfield et al. | |
| 2009/0235570 | A1* | 9/2009 | Sammut | F41G 1/473 42/122 |

OTHER PUBLICATIONS

W. A. Kenney: Improved Ballistic Wind Prediction Using Projectile Tracking Data, Old Dominion U. Summer 2017. https://digitalcommons.odu.edu/cgi/viewcontent.cgf?article^^1007&context^^msve_etds.

(Continued)

*Primary Examiner* — Jamara A Franklin
(74) *Attorney, Agent, or Firm* — Gerhard W. Thielman

(57) ABSTRACT

A computer-implemented method is provided for implementing wind correction for a projectile launching gun aiming at a target on a gun fire control system on an aircraft. The fire control method includes obtaining first physical parameters; executing a ballistics model to obtain a flight path of the projectile; obtaining number of points for wind direction and velocity across altitudes; executing a tracker model to obtain tracker location and initial gun state; obtaining closure tolerance and cross-correlation factor; modeling wind prediction to obtain a predicted wind column; incorporating the predicted wind column for wind column prediction for a projectile effect; and applying the projectile effect to the fire-control processor to adjust aiming the gun. The first physical parameters include wind column, gun state, ammunition type and aircraft flight conditions. The ballistics model obtains a flight path of the projectile based on the first physical parameters. The tracker model is based on the number of points and the flight path. The wind prediction is based on the closure tolerance, the cross-correlation factor, the tracker location and the initial gun state. The wind direction and velocity are obtained from multiple measurements or alternatively from a single-point measurement.

6 Claims, 22 Drawing Sheets

(56) References Cited

OTHER PUBLICATIONS

J. D. Pinezich et al.: "Ballistic Projectile Tracking Using CW Doppler Radar", *IEEE Trans. on Aero. & Elec. Sys*. 46 (3), Jul. 2010. https://www.researchgate.net/publication/242782377_A_Ballistic_Projectile_Tracking_System_using_Continuous_Wave_Doppler_Radar/download.

* cited by examiner

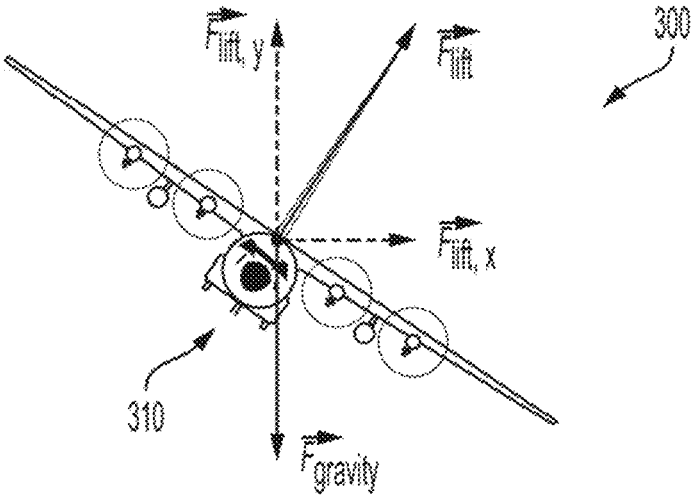

FIG. 3

400

Table 1. Flight Nominals 410

| Nominal |
|---|
| Air Speed [m/s] |
| Bank Angle [deg] |
| Altitude [m] |

Table 2. Static Values 420

| Static Round Properties |
|---|
| Mass |
| Initial Spin |
| Initial velocity |
| Moment of inertia |
| Diameter |

Table 3. Projectile State Data 430

| Initial State Data |
|---|
| Location |
| Velocity Vector |
| Accelerations |
| Orientation |
| Spin |

Table 4. Variables and Ranges 440

| | |
|---|---|
| Altitude | 6000 to 20000 |
| Gun Quadrant Elevation | -60 to -10 |
| Aircraft speed | 100 to 250 |

FIG. 4

800

Table 5. Curve fitting constants at varying closure tolerances

810

| $d_{tol}$ [m] | $a$ | $b$ | $c = \frac{a}{d_{tol}}$ |
|---|---|---|---|
| 1 | 4.331439579 | -1.357146875 | 4.331439579 |
| 0.5 | 2.216156149 | -1.364725952 | 4.432312298 |
| 0.1 | 0.437442152 | -1.359738326 | 4.374421522 |
| 0.05 | 0.221737097 | -1.366364296 | 4.434741948 |
| 0.01 | 0.04373935 | -1.359060356 | 4.373934976 |
| 0.005 | 0.021994055 | -1.362480741 | 4.398811037 |
| 0.001 | 0.004424346 | -1.363123512 | 4.424346263 |
| 0.0005 | 0.002193684 | -1.362639354 | 4.387367296 |
| 0.0001 | 0.00042972 | -1.353061278 | 4.294720087 |
| 0.00001 | 4.29354E-05 | -1.352526276 | 4.293535625 |

Table 6. Increase in iterations at each CCCC setting

820

| CCCC value | Change in average iterations |
|---|---|
| 1.07 | +0.2528 |
| 1.08 | +0.4664 |
| 1.09 | +0.695 |
| 1.1 | +0.8958 |

FIG. 8

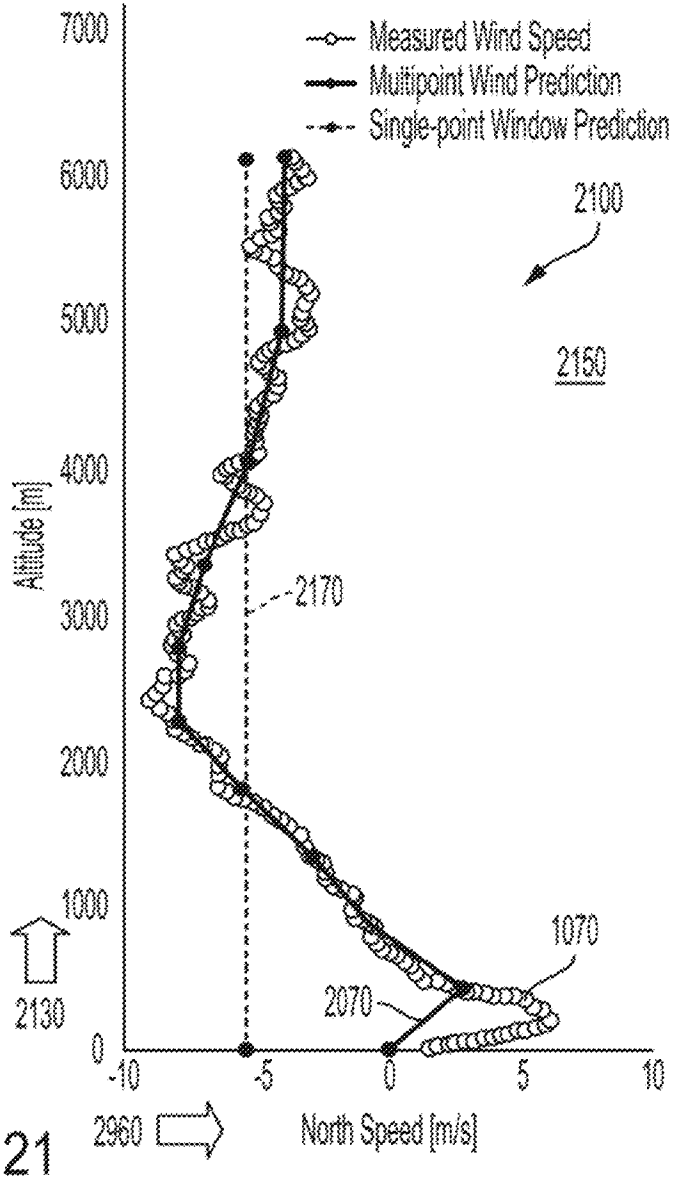
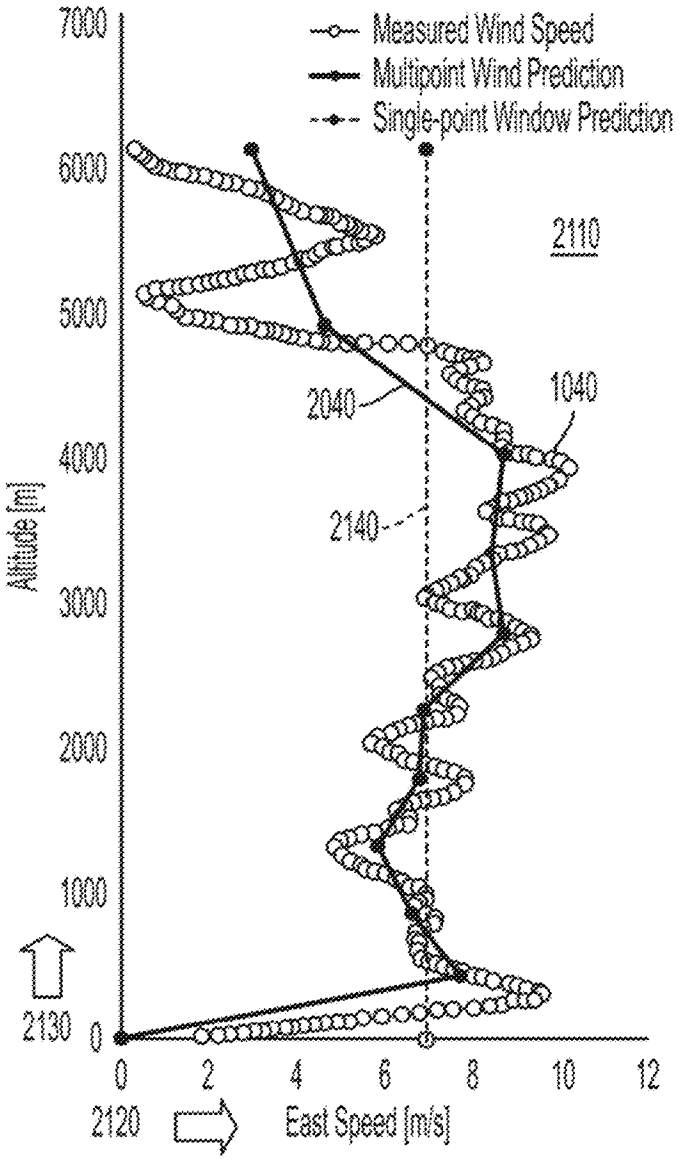
FIG. 21

2300

2310

Table 7. East Wind Prediction Standard Deviations.

| | Single-Point Winds | | | Multipoint Winds | | |
|---|---|---|---|---|---|---|
| Wind Profile | Minimum Standard Deviation | Mean Standard Deviation | Maximum Standard Deviation | Minimum Standard Deviation | Mean Standard Deviation | Maximum Standard Deviation |
| 1 | 1.2161 | 1.5792 | 2.4391 | 0.3621 | 0.9251 | 2.0271 |
| 2 | 2.3266 | 2.5367 | 3.1084 | 0.2992 | 0.683 | 1.2207 |
| 3 | 2.0204 | 2.1347 | 2.5729 | 0.4105 | 0.7009 | 1.183 |
| 4 | 1.275 | 1.345 | 1.4712 | 0.3273 | 0.6992 | 1.4409 |
| 5 | 1.7555 | 2.0986 | 2.5513 | 0.2532 | 0.5283 | 0.8325 |
| 6 | 1.554 | 1.7389 | 1.9525 | 0.2188 | 0.6177 | 1.0783 |
| 7 | 1.77 | 1.9884 | 2.2842 | 0.3199 | 0.6162 | 0.9786 |
| 8 | 3.0781 | 4.0204 | 4.2104 | 0.4303 | 0.8972 | 1.9493 |
| 9 | 1.9915 | 3.7176 | 4.876 | 0.3269 | 0.6379 | 1.1723 |
| 10 | 2.0352 | 3.8236 | 4.9568 | 0.2887 | 0.6955 | 1.2939 |
| 11 | 3.0554 | 4.1683 | 4.8265 | 0.4067 | 0.8335 | 1.3303 |
| 12 | 2.8555 | 4.5899 | 5.2277 | 0.4537 | 0.7946 | 1.3834 |
| 13 | 2.4794 | 4.0481 | 4.8305 | 0.4524 | 0.7175 | 1.1287 |
| 14 | 1.0993 | 1.4245 | 1.6939 | 0.1536 | 0.4464 | 0.8481 |
| 15 | 1.0584 | 2.4476 | 3.175 | 0.1316 | 0.2708 | 0.6604 |
| 16 | 0.7948 | 1.1161 | 1.2631 | 0.1524 | 0.4335 | 0.7528 |

FIG. 23

2400

Table 8. North Wind Prediction Standard Deviations.

2410

| Wind Profile | Single-Point Winds | | | Multipoint Winds | | |
|---|---|---|---|---|---|---|
| | Minimum Standard Deviation | Mean Standard Deviation | Maximum Standard Deviation | Minimum Standard Deviation | Mean Standard Deviation | Maximum Standard Deviation |
| 1 | 3.2787 | 3.827 | 4.2988 | 0.3513 | 0.7362 | 1.2444 |
| 2 | 2.2198 | 3.6316 | 3.933 | 0.3775 | 0.6041 | 0.8957 |
| 3 | 1.6486 | 3.8577 | 4.5504 | 0.3022 | 0.4917 | 0.7517 |
| 4 | 1.8693 | 3.5132 | 4.0889 | 0.4062 | 0.5596 | 0.7085 |
| 5 | 1.2484 | 3.3368 | 4.4162 | 0.3522 | 0.6306 | 0.9217 |
| 6 | 0.8832 | 3.9108 | 5.6004 | 0.1917 | 0.6801 | 1.2459 |
| 7 | 1.2946 | 4.6566 | 6.0629 | 0.3275 | 0.6804 | 1.1147 |
| 8 | 0.4367 | 1.0038 | 2.4769 | 0.2363 | 0.4156 | 0.8389 |
| 9 | 1.6515 | 1.8375 | 2.3687 | 0.3165 | 0.4826 | 0.9701 |
| 10 | 2.1361 | 2.3121 | 2.7561 | 0.3326 | 0.6329 | 1.048 |
| 11 | 1.8327 | 2.0703 | 2.2921 | 0.3683 | 0.6424 | 0.9169 |
| 12 | 1.2763 | 1.7028 | 2.3567 | 0.3198 | 0.6306 | 0.86 |
| 13 | 1.5332 | 1.7027 | 2.0344 | 0.3224 | 0.5711 | 0.9382 |
| 14 | 0.5164 | 0.5792 | 0.8742 | 0.1493 | 0.3907 | 0.632 |
| 15 | 0.9481 | 1.4738 | 1.6395 | 0.1714 | 0.2584 | 0.3724 |
| 16 | 0.828 | 0.9761 | 1.1553 | 0.2211 | 0.4849 | 0.7842 |

Table 9. State Variation Ranges

2420

| State Variable | Distribution |
|---|---|
| Altitude [m] | U(-50.0, 50.0) |
| Aircraft Speed [m/s] | U(-25.0, 25.0) |
| Gun Elevation [deg] | U(-5.0, 5.0) |

FIG. 24

BALLISTIC WIND CORRECTION TO IMPROVE ARTILLERY ACCURACY

CROSS REFERENCE TO RELATED APPLICATION

Pursuant to 35 U.S.C. § 119, the benefit of priority from provisional application 62/730,745, with a filing date of Sep. 13, 2018, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to wind correction for ballistic projectiles. In particular, the invention relates to incorporation of multiple data points to compensate for errors from wind effects on ballistic trajectories.

SUMMARY

Conventional wind corrections for ballistic flight predictions yield disadvantages addressed by various exemplary embodiments of the present invention. In particular, various exemplary embodiments yield wind corrections based on ballistic influence from empirical wind profiles. These embodiments provide a computer-implemented method for implementing wind correction for a projectile launching gun aiming at a target is provided on a gun fire control system on an aircraft. The fire control method includes obtaining first physical parameters; executing a ballistics model to obtain a flight path of the projectile; obtaining number of points for wind direction and velocity across altitudes; executing a tracker model to obtain tracker location and initial gun state; obtaining closure tolerance and cross-correlation factor, modeling wind prediction to obtain a predicted wind column; incorporating the predicted wind column for wind column prediction for a projectile effect; and applying the projectile effect to the fire-control processor to adjust aiming the gun.

The first physical parameters include wind column, gun state, ammunition type and aircraft flight conditions. The ballistics model obtains a flight path of the projectile based on the first physical parameters. The tracker model is based on the number of points and the flight path. The wind prediction is based on the closure tolerance, the cross-correlation factor, the tracker location and the initial gun state. The wind direction and velocity are obtained from multiple measurements or alternatively from a single-point measurement.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which: [need hardware diagram]

FIG. 3 is a plan frontal view of an aircraft's Free-Body Diagram;

FIG. 4 is a tabular view of Nominal, Static, Initial State, Variable and Range Values (Tables 1, 2, 3 and 4);

FIG. 8 is a tabular view of a curve-fitting constants, iteration change, variables and ranges (Tables 5 and 6);

FIG. 21 is a graphical view of Comparison of Single-point and Multipoint Models;

FIG. 23 is a tabular view of East Wind Prediction Standard Deviation (Table 7);

FIG. 24 is a tabular view of North Wind Prediction Standard Deviation and State Variation Ranges (Tables 8 and 9);

DETAILED DESCRIPTION

Figure 1:
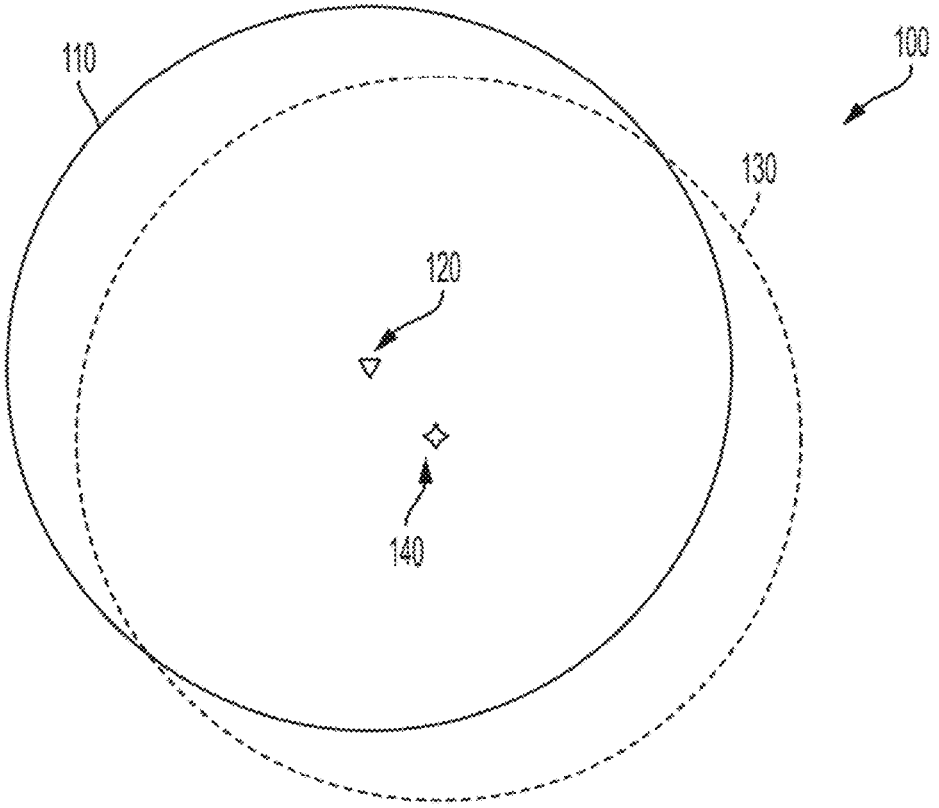
FIG. 1 is a schematic view of a Wind Corrected Orbit.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In accordance with a presently preferred embodiment of the present invention, the components, process steps, and/or data structures may be implemented using various types of operating systems, computing platforms, computer programs, and/or general purpose machines. In addition, artisans of ordinary skill will readily recognize that devices of a less general purpose nature, such as hardwired devices, may also be used without departing from the scope and spirit of the inventive concepts disclosed herewith. General purpose machines include devices that execute instruction code. A hardwired device may constitute an application specific integrated circuit (ASIC), a field programmable gate array (FPGA), digital signal processor (DSP) or other related component.

The disclosure generally employs quantity units with the following abbreviations: length in meters (m), mass in kilograms (kg), time in seconds (s), angles in milli-radians (mrad) or degrees (°), and force in newtons (N).

Chapter I—Introduction: Using new round tracking capabilities, one can track a fired ballistic projectile or round. From these tracking data, an improved ballistic wind prediction can be made that is superior to previous methods of ballistic wind prediction due to the increased data from the round tracker. This improved ballistic wind prediction can then be used to correct gun fire-control modeling of the round in flight and produce a better firing-solution to increase gun fire accuracy.

This topic is being pursued because of the inability of current United States Air Force (USAF) AC-130 gun-ships to correct for winds in a detailed manner. Conventional methods of wind prediction are low fidelity and tend to lose validity provided the aircraft and gun change state so as to alter the time of flight of the round. The method employed in exemplary embodiments greatly reduces the effects of state changes on the impact prediction. Incorporation of the exemplary techniques on the AC-130 via a fire-control (FC) processor for aiming the gun enables improved ballistic wind prediction, which leads to better firing solutions, which augments overall performance by ability to predict detailed ballistic winds that more closely match the true winds acting on the round. Exemplary embodiments reduce not only the bias on impacts due to the wind effects but also reduce dispersion induced by changing the state of the aircraft and gun.

Conventional ballistic wind prediction methods rely on knowing only the final impact of the round. As such, the ballistic wind generated is a single value ballistic wind, holding a constant wind speed and direction at all altitudes. This type of wind prediction is only valid in gun fire states close to state where the wind prediction was made. For a gun fired in a state different from the prediction state, the ballistic wind is likely to be incorrect. This inaccuracy in the ballistic wind leads to incorrect fire-solution angles being used to fire the gun, causing rounds to impact away from the intended target. This has two effects. First, more rounds are needed to ensure effect on target. Second, the gun weapon system is less usable close to blue (friendly) forces due to the increased chance of rounds impacting far off the target and threatening collateral damage.

USAF AC-130 gun-ships have been in operation since the Vietnam War and have seen frequent use during recent conflicts. They are able to employ gun weapon systems from above a target in a manner that maximizes possible time on target. When firing, the gun operators must deal with miss distances caused by winds acting on the projectile in flight. Operators currently perform a "tweak" to predict a ballistic wind affecting fired rounds that is then incorporated in the fire-control to correct for the real winds and bring shots onto target. This correction, a single-point wind prediction, is made using only the initial state of the gun and aircraft and the final impact location. This disclosure explores the possibility of using a round tracking sensor to track a projectile as it falls and produce a multipoint ballistic wind that would be better at correcting for the true winds than a single-point ballistic wind.

An exemplary algorithm for a multipoint wind prediction method is described and validated by executed simulation with a single-point prediction method against measured wind profiles. The results of the single-point and multipoint ballistic winds are compared to the measured winds to test for a goodness of fit. The results are also tested for stability; that when used the ballistic wind remains valid even when the aircraft and gun change state from the initial state when the ballistic wind was predicted. The results show that a multipoint ballistic wind that is a better fit and more stable ballistic wind than a single-point ballistic wind is possible using the exemplary algorithm presented. Also, the multipoint ballistic wind can be produced with very few data points along the trajectory of the projectile.

When firing a gun, winds tend to be the largest uncontrollable error contributor to final impact miss distance. Most other errors, such as aiming and accounting for projectile physical parameters, can be minimized prior to firing. The winds and their effects on the round throughout its flight cannot be known before firing. This is true regardless of the type of gunfire, be it stationary and ground based or in motion on an orbiting aircraft. For a stationary gunner, winds and other errors can be corrected for by applying an offset to the pointing angles of the gun, called "Kentucky Windage" as a simplifying assumption. This type of correction assumes that all errors observed on one shot acts the same on the next shot. For example, assuming wind and other errors combine to force a round to impact high and to the right of a target, then a stationary gunner can apply Kentucky Windage to the shot by aiming low and to the left of the target.

For moving gunners this type of correction does not apply, especially for an orbiting gun-ship such as the USAF AC-130 gun-ships. When circling a target error effects that manifest themselves in different frames of reference mixes in such a way that Kentucky Windage cannot be used to correct the errors. A method of separating the errors into their specific reference frames and accounting for each error source individually is needed. Correcting the wind error when firing from an orbiting gun-ship has been addressed in each iteration of the AC-130 gun FC system. Each model's operators have had a method of correcting the observed wind induced miss distance suited to their specific method of FC, whether by changing the orbit center or using a "tweak" by estimation.

However, little literature exists on these methods. The Technical Orders (TO) for past gun-ships describe in general terms either the method of correction via changing the orbit center or the intent of the correction via a tweak. Research into the exact methods of predicting a ballistic wind have not been published in a publicly accessible database. Whether this is due to protection of intellectual property or classification of the method is not clear. Conventional methods attempt to predict a ballistic wind using only the initial firing conditions and the final impact of the round. This can be done to correct for the wind effects on the round, though the ballistic wind predicted can lose validity over time and as the aircraft changes state. A single-point ballistic wind is computationally easy to calculate. The prediction requires no more hardware than would already be available for normal operations of a gun FC system; a method of measuring the aircraft and gun state and a sensor to detect and locate the round's impact.

The single-point ballistic wind has been in operation for years on USAF AC-130 gun-ships. This conventional method is trusted and has been shown to be effective. The limitations are well known. The ballistic wind values can be invalid for an aircraft changing state from the time of the original calculation to the time of fire, even if only changing the altitude of the aircraft. A more flexible and stable method of modeling the winds would improve overall gun accuracy. A multipoint ballistic wind prediction is possible, though not with technology conventionally operable on the AC-130 gun-ships. In order to create a multipoint ballistic wind, the location and speed of the round must be known at various locations along the projectile's flight path.

Round tracking sensors exist and could be used to provide this telemetry data to an FC system. Could a round tracking system be implemented to allow for the calculation of a more stable ballistic wind? This research tests the hypothesis that a more stable ballistic wind profile can be calculated using data from a round tracking sensor. The multipoint ballistic wind prediction can be made with very few data points and can be done in a way that is suited to a tactical application of the algorithm. A tactically employable algorithm can be developed to predict more dynamic ballistic wind profiles would increase the accuracy of the gun weapon system. Assuming that the system would track each round fired, winds could be predicted for each round individually. Using the winds from the most recently fired round the FC system could improve the firing solution for the subsequent round. This does not lead to first round accuracy but introduces the possibility of greatly improved accuracy for all following rounds. The disclosure for exemplary embodiments is divided into seven chapters, including this Introduction. Chapter II explains the current state of the systems to be modeled for this research. The conventional state-of-the-art for aircraft flight, the FC system, wind correction method, and projectile tracking systems are described. Chapter III describes the models designed and implemented to recreate the relevant parts of the real-world systems described in Chapter II.

The modeling assumptions and limitations are presented along with the expected input and output. Validation of the individual models is discussed, though the validation criteria and results are not presented. Two factors controlling the performance of the wind prediction model are tuned and the results are discussed in Chapter IV. Chapter V uses the models to simulate the current wind prediction method, a single-point wind correction. Real measured winds are used and the wind prediction model finds a single value ballistic wind to account for the effects of the measured winds. Chapter VI uses the same measured winds and initial conditions used in Chapter V to predict a ballistic wind based on multiple points along the flight path of the round. The multipoint wind prediction method is described and the results of the simulation runs are presented.

Assuming the above hypothesis is correct, then the wind predictions from Chapter VI should prove to be more stable than the wind predictions made in Chapter V. Chapter VI investigates the closeness of the predicted winds to the true winds to indicate which ballistic wind method performs better. The ballistic winds are also tested as the state of the aircraft and gun are changes to see which ballistic wind method performs better, allowing less error into the impact prediction. Chapter VII presents the conclusion to the research. Along with summing up the results presented, recommendations are presented for future experiments or analysis and a discussion of some of the remaining limitations on an FC system using the multipoint wind prediction method described in Chapter VI.

Chapter II—State of the Art: This research is focused on determining whether increased knowledge of a ballistic projectile's location in flight can be used to make ballistic wind predictions that closely match the true winds acting on the projectile. Specifically, this disclosure examines at a weapons platform that relies on wind predictions to improve weapon effectiveness; USAF AC-130 gun-ships. In order to establish a framework developed in Chapter III for the models and simulation, this section reviews the conventional state of technology of the modeled systems and subsystems.

This description is by no means exhaustive, but provides adequate details and background data to enable the design and implementation of models to recreate the system of interest. A brief description of USAF fixed-wing gun-ships is presented, describing the theory of operations and the flight profile used during a weapons engagement. Gun weapon systems require an FC system to properly point the gun so that rounds fired strikes the desired target. Features of an FC are detailed and errors common to FC systems are discussed. One of the most common and largest errors experienced by FCs is the effect of wind on the projectile. Existing methods to predict the effects of wind and account for them to improve impact accuracy are described. Finally, various round tracking systems and their configurations are detailed.

Section II.1—Side-Firing Gun-ships: Shortly after the first flight by the Wright brothers in 1903, airplanes were adopted for military use. In 1909, the US Army Signal Corps purchased and used the first military aircraft. Early uses included both combat and non-combat roles. The first recorded deployment of a gun on a military airplane occurred in 1915 when French pilot Roland Garros used a forward firing machine-gun to engage enemy aircraft. For engaging ground targets, some early aviators carried rifles in flight that they would fire sideways out of the cockpit. In the 1920s both the Americans and the French mounted side-firing guns on various aircraft, though there was no specific tactic developed to employ such weapons.

One of the problems faced with all air-to-ground engagements is the aircraft's typically short time to engage the target. Strafing a target or engaging in a fly-by attack allows for a short period of time where weapons can be brought to bear on a target. A pilot then must turn the aircraft and reacquire the target before they can reengage. Pilots both military and civilian had developed a maneuver called the "pylon turn" by the 1920s. The pylon turn is a maneuver where the pilot turns the aircraft at a constant bank angle. This has the effect of pulling the aircraft into a roughly circular turn around a stationary ground location. Pilots had developed the pylon turn maneuver for airplane racing.

Military aviators saw the advantage of combining side-firing weapons with a coordinated pylon turn. The tactic was initially tested in 1926 by the US Army and developed from there into the side-firing fixed wing gun-ships used today. A pylon turn is defined by the bank angle of the aircraft, the aircraft's speed, and the altitude of flight. There values are called the "nominals" and they control the geometry of the pylon turn. With a given set of nominals the total range from the gun to the target, the slant range, can be calculated. Nominals can be chosen to achieve a specific slant range.

There are many advantages to using side-firing weapons in a pylon turn. From a combat perspective the primary advantage is increased weapon time on target. A pylon turn can be executed around a specific target or target area that enables the weapon to be trained on the target for the duration of the orbit. Side-firing weapons employed without using a pylon turn and forward firing weapons have a limited time to engage before the aircraft has passed the target and must turn to reengage. Along with increasing the time available to fire at the target, the pylon turn reduces the apparent target motion relative to the aircraft. Provided the pylon turn is properly executed, a target can be placed at the center of the orbit. From the perspective of an observer on the aircraft, a target at the center of the orbit appears stationary. Even though the aircraft is in motion the target appears stationary relative to the aircraft facilitating target engagement.

The idea of combining side-firing guns with aircraft executing a pylon turn was first tested in 1926 but was not pursued by the US military at that time. During World War II the US military proposed using a side-firing gun on an aircraft to engage submarines, but again the tactic was not pursued. Not until the Vietnam War did the US military operate a true side-firing gun-ship executing a pylon turn. Pylon turns are the standard flight profile for modern USAF AC-130 gun-ships. The side-firing guns can be trained on targets throughout the orbit and engage for extended periods without losing sight of the target. Pilots select nominals to fly in order to hold a specific slant range around a target. The nominals determine the geometry of the orbit and the target-to-gun system. The selection of the nominals varies based on pilot preference and mission needs.

Section II.2—Gun Fire Control: When a gun-ship engages a target with its guns, a firing solution must be calculated. The firing-solution is a set of gun pointing angles (azimuth and elevation) that enables a round fired by the gun to impact the intended target. The firing-solution takes into account the current state of the aircraft and target location. For modern gun weapon systems, the FC (as a system processor) calculates the firing-solution. The FC ties together different data sources available on the gun-ship and uses those data to compute the firing-solution. The specific operations and functions of a given FC may vary based on hardware and software design considerations, but the common functions are as follows.

(1) obtain target location data from a sensor system.

(2) convert the target location from a sensor-relative frame of reference to a gun-relative frame of reference.

(3) use ballistic model to predict a set of azimuth and elevation gun angles that enables a ballistic projectile to impact the target location.

(4) move the gun into position to match firing-solution.

(5) fire the gun.

Each of the above steps involves many hardware components providing input data on the state of the gun, target, and aircraft as well as software algorithms to calculate the required pointing angles and control the gun weapon system. A full discussion of such FCs is beyond the scope of this research. Pertinent to this research are the possible errors in the firing-solution generated by the FC.

Failure of the round to strike the intended target indicates an error in the firing-solution. The error is judged by the characteristics of how the round missed the target. There are many sources of possible error in the FC and its generated firing-solution. A full list of the error sources depends on the specific configuration and design of the system, but some common error sources are poor ballistic modeling, mechanical errors controlling the pointing of the gun, incorrect targeting data, winds, and production tolerances for the ammunition. During the development of the FC system, concerted efforts reduced any errors that can be eliminated & priori based on gaining more knowledge of the FC. For example, the initial velocity of the round is found through testing and is treated as an input to the FC.

Each round has a different initial velocity, which cannot be known before firing. The initial velocities measured during testing result in a distribution of possible values. The average initial velocity value is used in the FC, thus accounting for an epistemic error that would exist even assuming the initial velocity had not been measured at all. The variability in the initial velocity still exists as an aleatory error that cannot be corrected. All errors in the system can be described as causing either a bias or dispersion on the round impacts. A bias error causes round impacts to be offset from the intended target in a repeatable and predictable way. Dispersion errors cause the rounds to impact within a "cloud" or region but not a single repeatable location.

When firing from an orbiting aircraft, impacts can be tracked in two frames of reference: a platform relative frame and a world relative frame. Biasing effects manifest in one of these two frames as a roughly static offset. Because the aircraft is orbiting, a bias in one frame appears to drift in the other frame in a predictable way based on the heading of the aircraft at time of fire. The platform relative frame of reference is fixed to the aircraft. Regardless of the aircraft orientation, the Y-axis of the platform relative frame is oriented with the positive direction pointing vertical and parallel to the gravity vector at the aircraft.

The X-axis, called the down-range (DR) direction, points with the positive direction to the left side of the aircraft orthogonal to the Y-axis. The Z-axis, called the cross-range (CR) direction, completes the right-handed system and points with the positive direction to the nose of the aircraft. When discussing errors in round impacts away from the target, the origin of the platform relative frame is assumed to be at the intended target. Platform relative biases are roughly static as observed from the aircraft. These bias errors can be corrected by applying a static offset to the gun pointing angles. This correction can be held through the entire orbit. Examples of platform relative bias include gun barrel misalignments, poor ballistic modeling, and inaccuracies in the body description and physical properties of the round being fired.

The world relative reference frame is a local East-North-Up (ENU) reference frame. When discussing errors in impacts, the origin of the world relative frame is at the target. The X-axis points positive to the East, the Y-axis points positive to the North, and the Z-axis completes the orthogonal system pointing positive upwards parallel to the gravity vector. World relative biases are static as observed from the ground. A world relative bias causes all shots to fall in roughly the same direction in East and North relative to the target. These biases can also be corrected by applying an offset to the gun pointing angles. The offset is not static and changes as the aircraft orbits the target location.

Winds account for the world relative bias affecting the flight of ballistic projectiles. Dispersion effects also manifest in specific frames depending on the cause of the error. Given the nature of dispersive errors, they cannot be separated into a specific frame of reference. The dispersion appears as "noise" on the impacts regardless of the frame of reference they are rendered in. In flight, attempts can be made to correct for biases that could not be corrected for on the ground. To detect and remove biases in both the platform and world reference frame multiple shots must be taken at headings around the orbit. This is required to decouple world relative bias from platform relative bias. Once the shot data are collected and decoupled the appropriate corrections can be made to the pointing angles of the gun to remove any platform or world relative bias.

Section II.3—Correcting for Winds: Winds affect the flight of a projectile in two ways, as a bias and as a dispersion in the observed impacts. The wind's average effect on the projectile causes a world relative bias, moving the impact of the round to a roughly constant location as measured in meters East and North of the target. While there is no such thing as a true average wind, there is a component of the wind column that changes very slowly over time, which is generally regarded as the average wind.

The average wind speed column, if known, does not capture all of the wind effects. The wind's dispersive effect on the round is due to the variability of the winds over time and unpredictable gusts that occur after the round is fired. Gusts and variability in wind speeds close to the ground always cause dispersion on the impacts that cannot be accounted for 6 priori. One can account for the offset in the impacts due to the average wind column. Historically, two different ways have been used to correct for wind effects with weapon systems: wind-corrected orbits and ballistic wind adjustment. Each method relies on knowing only two points, the initial firing conditions and the final impact, to correct the impacts. When firing from a pylon turn, the target is usually at the center of the orbit to maximize weapon time on target and minimize the need to change gun pointing angles to fire on a target.

FIG. 1 illustrates a diagram view 100 of orbit paths of an aircraft, such as the AC-130. An orbit path 110 is shown as a solid circle with a target center 120 shown as a triangle that identifies a target subject to attack. A wind-corrected orbit path 130 to adjust the aim point is shown as a dash circle with an impact center 140 shown as a cruciform. The impact center 140 denotes the impact site due to wind shifting the projectiles fired from the aircraft while in ballistic trajectory flight.

Assuming winds are present and causing the impacts to fall in a roughly constant location East and North relative to the intended target 120, the orbit path 110 can be offset to correct for this miss. Adjusting the center point of the orbit by the same magnitude as the average wind induced miss distance in the opposite direction causes shots fired at the center of the orbit to impact on the original target shown in view 100 as a wind-corrected orbit path 130. The target 120 is no longer in the center of the orbit path 110 but the gun is still aimed as though the target was located at the center 120. Offsetting the impact center 140 was commonly used in older gun-ships because it did not require extensive ballistic calculations or fully trainable gun systems.

Modern FC and gun weapon systems are capable of recalculating ballistic solutions and training the guns automatically to account for offsets required to bring missed impacts back on target. This method, referred to as a "tweak" in this context, also encompasses correcting for alignment offsets as well as the winds. The wind correction result of the tweak algorithm is a "ballistic wind." The ballistic wind is not a measure of the true winds affecting the round in flight. Ballistic winds are an approximation of the winds from the tip of the barrel to the ground level that would account for the observed wind induced miss distance. A ballistic wind is a single wind speed and direction value, which is assumed to apply for the entire flight path of the projectile.

The tweak process finds the ballistic wind that best accounts for the observed world relative bias in any impact data. Multiple shots are taken and the miss distances are recorded. Using the impact data, a search algorithm is used to iterate over a search space of possible wind vectors. The wind model is then applied to the ballistics model 260 in the FC 290. Applying the winds in the ballistics model 260 under the initial firing conditions, an impact is predicted. The algorithm varies the parameters of the wind model to reduce the difference in the observed impacts the predicted impacts with ballistic winds applied. The ballistic winds predicted by the tweak are valid only for a period of time. This period varies based on the wind itself; no clear time limit exists. For calm winds that are slow to change when the ballistic wind is calculated, the tweak results may be valid for a long period. For highly dynamic true winds that change rapidly, then the tweak results may become "stale" in a short period.

Section II.4—Tracking Projectiles: Technology exists to track a projectile in flight. Such round tracking technologies fall broadly into two categories: internal trackers and external trackers. Internal trackers, also known as telemetry rounds, contain hardware to detect or measure their location and relay that data back to a base station. Telemetry rounds contain some form of global positioning system (GPS) or Inertial Navigation Unit used to measure the location of the round in flight. The round then transmits that information to a base station that records the information.

Telemetry rounds require changes to the projectile itself to enable the inclusion of the necessary hardware and are commonly inert. Any explosive warhead being removed to enable the inclusion of the tracking hardware. These rounds are often used in experiments where the terminal effects of the round are not under study. Because of the changes, telemetry rounds may not be representative of the rounds intended for tactical use.

External trackers are sensors that track the round in flight without needing the round itself to transmit a signal to the tracker system. There are a variety of methods used to track projectiles in flight. A rigid body system measures a direct range and pointing angles to the projectile from a known sensor location. A Doppler system pings the projectile with a radio or microwave signal and finds the round's velocity based on the Doppler shift of the return signal. The round's velocity is integrated over time to predict the position of the projectile. Sensor array systems exist that rely on the pointing angles of multiple sensors pointing at the round in flight and triangulation to find the location of the round. For each external system, some form of sensor must be used. These all rely on reflected electromagnetic radiation to detect and locate the round. The specific sensor configuration used depends on the composition material the round.

Light Detection and Ranging (LIDAR) systems can be used to track a round provided a portion of the round is painted so as to reflect LIDAR signals. Radar tracking functions with any round in current use as they are all metal jacketed, though round size is a limitation. Tracer rounds, those with base-burners, can be tracked with infrared or electro-optical sensors. Regardless of the method of tracking the round used, the tracker itself must measure or calculate the location of the round in some reference frame relative to some origin point. The frame and the target point are arbitrary. The only firm requirement is that the data be of such a form that they can be translated into a frame relevant to the weapon system.

Chapter III—Models: In Chapter II, the system of interest was described. This research investigates the incorporation of a round tracking system to predict a ballistic wind to reduce wind induced bias errors on projectiles fired from an AC-130 gun-ship. In order to simulate firing from an AC-130 gun-ship and attempt to correct for the wind effects on a projectile, a series of models were developed to recreate the systems described in Chapter II. A model is required to simulate the flight conditions of the aircraft at the time of fire. Chapter III describes the simplifying assumptions made in developing the model and also details the equations employed and the required input to the model. Early in the simulation design, the assessment was made that modeling the entire FC would greatly increase the complexity of the system, introducing greater chances for errors without increasing the level of fidelity of the simulation.

Instead of modeling the entire FC 290, a ballistics model 260 for use thereby, was developed to simulate the flight of a projectile. Section III.2 presents the design consideration made, the assumption inherent to the model, and the required input parameters. Section III.3 describes modeling the wind. A method is required that models a consistent wind both for developmental testing and for simulation of the ballistic wind predictions. Along with the winds, the developed model simulates the data supplied by a round tracking sensor. The modeling assumptions are fairly broad; the resultant model described in Section III.4 is designed to give the proper output expected from a round tracking system. Finally, Section III.5 describes a method of wind prediction and details a model. The internal algorithm is described along with the expected inputs and outputs to allow the wind prediction model to interact with the other models and their data.

Figure 2:
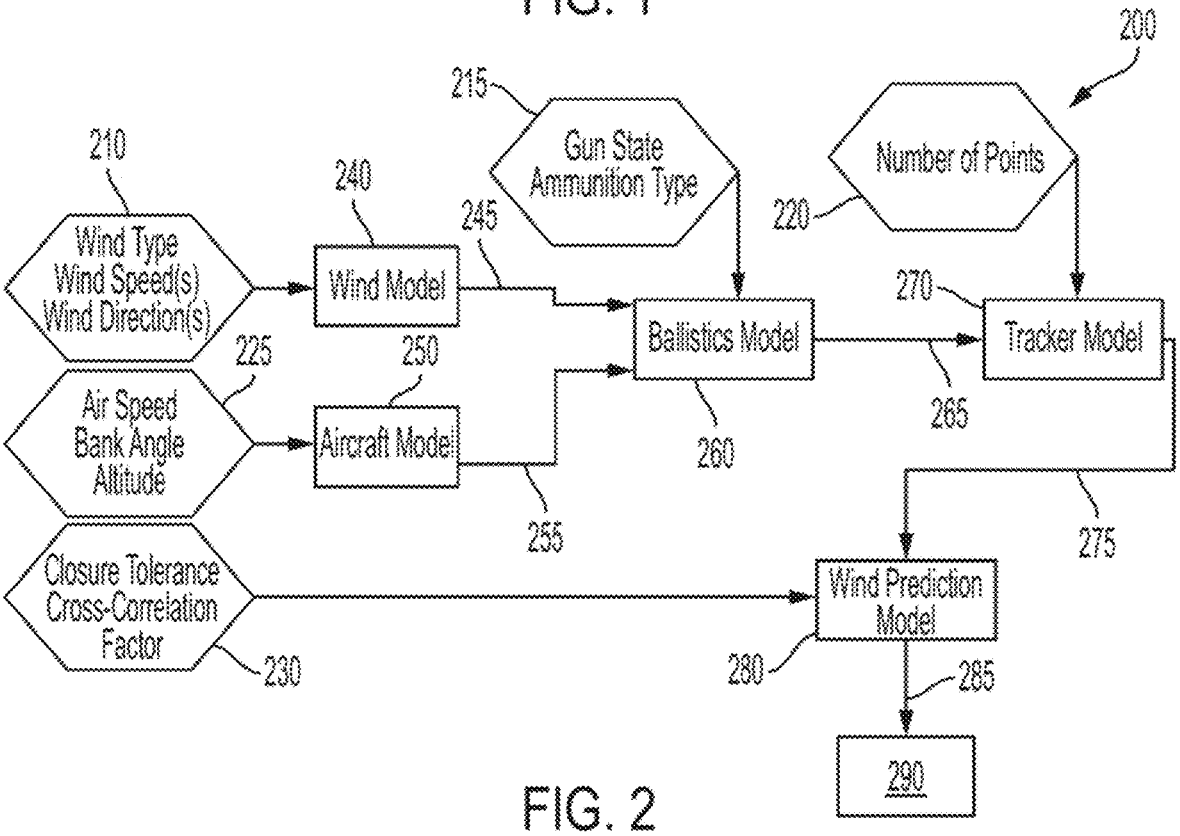
FIG. 2 is a flowchart view of a Model Architecture Diagram.

The high-level architecture of the resulting simulation software is shown in FIG. 2, in which one can observe what the expected inputs into each of the sub-models is and what data are being sent to the other models. All messages are sent via multicast network messages. FIG. 2 shows a flowchart view 200 of a Model Architecture Diagram. Inputs include wind characteristics 210, gun and ammunition characteristics 215, number of points 220 for wind data, aircraft characteristics 225, and iteration parameters 230. Wind characteristics 210 include type, speed and direction. Gun and ammunition characteristics 215 include state and type. Aircraft characteristics 225 include speed, bank angle and altitude. Iteration parameters 230 include closure tolerance and cross-correlation factor. Processes include wind model 240 to produce a wind column 245, aircraft model 250 to produce altitude, bank and speed 255, ballistics model 260 to produce a round's complete flight path 265, tracker model 270 to produce a tracker location and initial gun state 275, and wind prediction model 280 to produce a predicted wind column 285 for the FC 290. One can note that characteristics 225 and 255 are not distinct in this context, but shown as separate for sake of completeness. For a more refined model the of AC-130, then characteristics 255 would include additional information beyond a "pass through" of the nominal data.

The wind model 240 receives wind characteristics 210. The aircraft model 250 receives aircraft characteristics 225. The ballistic model 260 receives gun and ammunition characteristics 215, wind column 245 along with altitude, bank and speed 255 to produce the flight path 265. The tracker model 270 receives the number of points 220 and the flight path 265 to produce the tracker location 275. The wind prediction model 280 receives the iteration characteristics 230 and the tracker location 275 to produce the predicted wind column 285. The number of points 220 represents an integer setting to specify to the tracker model how many measured location/velocity data points to simulate for the rounds.

This design configuration ensures that the method of communication is as close as possible to that in a real tactical application of these systems. Also, by limiting the interactions of the various models to only those inputs and outputs shown in view 200, one can ensure that the wind prediction model 280 would only have access to those data that a hardware round tracking sensor would provide. This control of network messages prevents the chance of the wind prediction model 280 having knowledge of the underlying winds that would not truly be available to a wind prediction system.

Section III.1—Aircraft State: This research focuses on projectiles fired from aircraft executing a pylon turn. The aircraft motion in a pylon turn is a direct contributor to the state of the projectile at time of fire. The orientation of the aircraft and the speed of the aircraft are factors that must be accounted for when attempting to predict the motion of a projectile fired from the aircraft. A fully descriptive model of the aircraft's motion in flight is not needed for this analysis. For these purposes and timescales, the firing of a gun is a virtually instantaneous event from the moment of trigger to the time the round exits the barrel. The motion of the aircraft after the time of fire has no effect on the flight of the round. The motion of the aircraft before the round exits the barrel is only important in that it imparts a velocity to the round. This enables a simplified model of the aircraft's motion and state to be used. When modeling the ballistics of a projectile fired from the aircraft very few factors of the aircraft's state need to be considered. The model used here is as simple as possible to model an aircraft in a pylon turn and supply the needed inputs to the ballistics model.

Section III.1.1—Assumptions: The model assumes that the acceleration due to gravity is constant at all altitudes and latitudes. This is not strictly true—see eqns. (10) and (11). For the purpose of modeling the flight of the aircraft, the small changes in gravity due to changes in latitude or altitude alters the geometry of the orbit only slightly. This change does not affect the quality of the ballistics model 260 or the applicability of winds to the flight of the projectile. As such, the dynamic nature of the gravitational acceleration can be neglected.

This model further assumes that the geometry of the orbit is controlled only by those forces acting normal to the direction of travel of the aircraft. The forward motion of the aircraft is only used to apply a velocity to the system. Any forces acting in that direction, such as drag on the aircraft, are ignored. Similarly, any orientation of the aircraft off of the ideal nominals is assumed to be zero. The aircraft in this model experiences no pitching and no yawing between the velocity vector and the heading vector. One can assume that no winds aloft affect the flight of the aircraft. This is not realistic, but the aircraft dynamics in a winded orbit 130 do not directly affect the applicability of the winds to the ballistic prediction.

Section III.1.2—Model Description: With the assumptions applied, the geometry of the orbit is controlled by few factors. A free-body diagram of the remaining forces is shown in FIG. 3 as elevation view 300 of simplified forces of flight on an aircraft 310, which can be used to illustrate the system. The two most consequential forces acting on an aircraft 310 are lift and gravity. Gravity constantly pulls the aircraft 310 downward relative to the local geographic reference frame. Lift constantly pulls the aircraft upward normal to the wings of the aircraft 310. When the aircraft 310 is banked the lift vector can be decomposed into a vertical and horizontal force.

To keep the aircraft 310 flying at a constant altitude, the vertical component of lift must equal the force of gravity acting on the aircraft, such that $$\vec{F}_{lift,y}=\vec{F}_{gravity}, \tag{1}$$

Newton's second law states:

$$\vec{F}_{gravity}=m\vec{g}, \tag{2}$$

where m is aircraft mass in kilograms (kg) and $\vec{g}$ is gravitational acceleration in meters-per-second ($m/s^2$). For flat and level aircraft flight, the forces are balanced and no horizontal component exists. For a banked aircraft, the airspeed over the wings must be high enough that the lift force's vertical component can balance out the gravity force.

There is a remaining horizontal component to the scalar lift force when banked:

$$F_{lift,x}=mg\tan(\beta), \tag{3}$$

where β is the bank angle of the aircraft. This horizontal component of lift acts a centripetal force on the aircraft. To hold a constant turn radius, this force must balance with a centrifugal force. Substituting, one obtains:

$$F_{lift,x} = \mathrm{m\,g}\tan(\beta) = \frac{mv^2}{R}, \tag{4}$$

where ν is the airspeed of the aircraft in meters-per-second (m/s) and R is the turn radius of the orbit in meters (m). Rearranging one can find an equation to determine the turn radius of the orbit:

$$R = \frac{v^2}{\mathrm{g}\tan(\beta)}, \tag{5}$$

which matches the pilot guidance for choosing flight nominals used by AC-130 pilots.

Section III.1.3—Model Factors and Parameters: Inputs into the flight model are limited to the nominals. Pilots select a desired turn radius eqn. (5) to the intended target for an engagement. Based on this desired range to target a set of flight nominals are chosen. The variables from eqn. (5) are the flight nominals, which along with the altitude of the aircraft control the shape of the orbit and the slant range to target. Note that FIG. 4 provides tabular views 400 for Table 1 as 410 for flight nominals, Table 2 as 420 for static values, Table 3 as 430 for projectile state data and Table 4 as 440 for variables and ranges. The derivation above serves to demonstrate that the only state variables needed to describe the aircraft for this simulation are the list of nominal in Table 1 as 410.

Section III.1.4—Model Verification and Validation: The implementation of the model was verified through code inspection and unit testing. Code inspection was performed to ensure that the equations were properly coded, and that the inputs and outputs were of the proper form. Unit testing checked that known inputs produced expected outputs from the code. Similarly, the inputs and outputs were validated against an independently generated list of nominals. This Table 1 of nominals 410 is used to select effective nominals for weapon use in tactical situations and generated for use in tactical operations. The tabulations enable a pilot to select a desired turn radius and slant range and show the required nominals to achieve those range values. The results of the model for this simulation match the expected results from the independently generated tabular list.

Section III.2—Ballistics: The forces acting on a projectile in flight are well known and studied in the fields of physics and aeronautical engineering. When implementing a ballistic model to describe the motion of a spinning projectile in flight, the number of degrees-of-freedom (DOF) must be selected for the model. The number of DOF chosen controls the complexity of the model. When dealing with exterior ballistics, the DOF refer only to those possible motions of the round that are physically modeled. The maximum DOF in a ballistics model 260 is six.

This 6-DOF model would account for motion in all three spatial directions (as determined by the frame of reference chosen) and rotation about all three orientation angles (roll, pitch, and yaw). Typically, 6-DOF ballistics models are high-fidelity models used to study the body orientation of the round in flight or to model flight control and guidance on a round. One can simplify an exterior ballistics problem to a model with four-DOF (4-DOF). A 4-DOF model describes the motion of the round in all three spatial dimensions and allows for the rotation of the round around its central body axis. A 4-DOF model does not model the yawing and pitching motion of a projectile in flight as a true physical moment acting on the round's body. Instead, a 4-DOF ballistic model simplifies the yawing and pitching motions into a single term, the yaw of repose. The yaw of repose approximation assumes that the precession and nutation of the round early in its flight are very small magnitude and have no effect on the trajectory.

After the precession and nutation have settled out, the spinning of the round causes a yawing and pitching of the central axis of rotation for the round off of the velocity vector of the round. The Modified Point-Mass (MPM) model, a type of 4-DOF ballistic model, assumes that the yawing and pitching angles between these vectors can be combined into a single angular offset. This total angular offset is the yaw of repose, a steady state yawing and pitching of a gyroscopically stable round. For this analysis, the exterior ballistics model 260 designed and implemented is a version of the MPM 4-DOF model. The 4-DOF model was chosen as a basis for this research due to ease of coding and the general popularity of the model in both academic and defense applications.

Section III.2.1—Assumptions: The ballistics of the round is modeled with a 4-DOF model. The physical forces to be modeled can be restricted to drag, lift, Magnus, and gravity. The model terminates upon prediction of the round impacting the ground. This implementation of the ballistic model assumes a flat Earth. The purpose of the analysis is to study the effects of winds on the trajectory of the projectile. The curvature of the Earth, whether spherical, ellipsoidal, or flat would have no effect on the predicted trajectory of the round. The atmosphere is modeled using the International Civilian Aviation Organization (ICAO) standard atmosphere. The ICAO atmospheric model is used to find the air density and speed of sound at varying altitudes.

The ICAO atmosphere model assumes that any variations in air density or speed of sound due to variations in wind speed will be small and have little effect on the trajectory of the round when compared to the effect of the wind itself. The implemented model assumes that there are winds acting on the round. The winds act in a horizontal plane, specifically the DR/CR plane of the gun frame. Vertical winds are assumed to be nonexistent. The actual model generating the wind values is separate from the modeling of the ballistics and is described in Section III.3. The model does not include the Coriolis force on the round as the total effect is assumed to be small.

Section III.2.2—Equations of Motion: The model used in this research is based on the ballistic model used in the NATO Armaments Ballistic Kernel. This model is a 4-DOF MPM that models the forces acting on the round in a frame of reference aligned to the gun. A common term appears in many of the equations of motion. For ease of notation and computation, this term is simplified by the following relation:

$$Q = \left(\frac{\pi\rho d^2}{8\ \mathrm{m}}\right), \tag{6}$$

where Q is the common term, d is projectile diameter in meters (m), m is projectile mass in kilograms (kg), ρ is atmospheric density in kilograms-per-cubic-meter (kg/m$^3$). The drag force is modeled by the following:

$$\vec{D} = -Q\left(C_{D_0} + C_{D_{\alpha^2}}\alpha_\varepsilon^2\right)v\vec{v}, \tag{7}$$

where $C_{D_0}$ is dimensionless zero-yaw drag coefficient, $$C_{D_{\alpha^2}}$$

is dimensionless quadratic drag force coefficient, $\alpha_e$ is the projectile's magnitude of yaw of response in radians, v is the velocity magnitude and $\vec{v}$ is velocity vector of the projectile relative to the air in meters-per-second (m/s).

The lift force is modelled by the following:

$$\vec{L} = Q\left(C_{L_\alpha} + C_{L_{\alpha^3}}\alpha_e^2\right)|v|^2\vec{\alpha}_e, \tag{8}$$

where $C_{L_\alpha}$ is dimensionless lift force coefficient, $$C_{L_{\alpha^3}}$$

is dimensionless cubic lift force coefficient, and $\vec{\alpha}_e$ is the projectile's yaw repose vector in radians. The Magnus force is modeled on the following:

$$\vec{M} = -QdpC_{mag\text{-}f}(\vec{\alpha}_e \times \vec{v}), \tag{9}$$

where p is the axial spin rate of the projectile around the body axis of symmetry in radians-per-second, and $C_{mag\text{-}f}$ is dimensionless Magnus force coefficient.

The gravity force is modeled by the following:

$$\vec{g} = -g_0\begin{bmatrix} \frac{X_1}{R} \\ 1 - \frac{2X_2}{R} \\ \frac{X_3}{R} \end{bmatrix}, \tag{10}$$

where R is the radius of the earth assuming a spherical model of $R=6.356766\cdot10^6$ m and $g_0$ is the strength of the gravity vector at the origin of the gun frame:

$$g_0 = 9.80665(1-0.0026\cos(2\varphi)), \tag{11}$$

where φ is the geodetic latitude of the origin of the gun frame.

The total acceleration acting on the projectile at any given time is calculated using the following:

$$g_0 = 9.80665(1-0.0026\cos(2\varphi)), \tag{12}$$

where $\dot{u}$ is the total acceleration of the projectile with respect to the gun frame, $\vec{D}$ is acceleration due to drag force in eqn. (7), $\vec{L}$ is acceleration due to lift force in eqn. (8), $\vec{M}$ is acceleration due to Magnus force in eqn. (9), and $\vec{g}$ is acceleration due to gravity in eqn. (10). The spin of the projectile around its centerline of symmetry is the only rotational motion physically modeled in the 4-DOF model. The temporal change in spin acceleration $\dot{p}$ is modeled by the following:

$$\dot{p} = \frac{\pi\rho d^4 p v C_{spin}}{8I_x}, \tag{13}$$

where $C_{spin}$ is dimensionless spin damping moment coefficient and $I_x$ is the axial moment of inertia in kilogram-meters-squared.

The yaw of repose is modeled by the following:

$$\vec{\alpha}_\varepsilon = \frac{8I_x p\left(\bar{v} \times \dot{\bar{u}}\right)}{\pi\rho d^3\left(C_{M_\alpha} + C_{M_{\alpha^3}}\alpha_e^2\right)v^4}, \tag{14}$$

where p is current axial spin rate of the projectile in radians-per-second (rad/s$^2$), $\bar{u}$ is the current acceleration vector in meters-per-second-cubed (m/s$^3$), $C_{M_\alpha}$ is the dimensionless overturning moment coefficient, and $$C_{M_{\alpha^3}}$$

is the dimensionless cubic overturning moment coefficient. In eqns. (7) and (8), the higher order terms that depend on the yaw of repose are dropped. For example, the equation for drag can be expanded to include a quartic drag force effect due to the yaw of the projectile. This and other similar contributions from higher power terms of the yaw of repose are assumed to be zero. An earlier study has determined that the Modified Point-Mass model is able to predict the flight path of a round accurately provided the yaw of repose predicted in flight is 0.6 mrad or less. A yaw of repose with such a small magnitude has a negligible effect given the form of the quartic drag force term $$C_{D_{\alpha^4}}\alpha_e^4.$$

Section III.2.3—Model Factors and Parameters: The 4-DOF model used requires input parameters to model a specific ammunition type. For this analysis, the PGU-13 A/B round type is used for all simulated shots. This round type is used in many air-to-ground systems. The round description, including the aeroballistic coefficients and the physical constants, are taken from the Projectile Design and Analysis System (PRODAS) software suite. Each round type has a set of physically measurable properties that do not change relative to the air mass the round is traveling through. These values are listed in Table 2 as 420 in FIG. 4.

As the round travels through the air, the round interacts with the mass of air differently depending on the speed of the round relative to the speed of sound in the air mass. Each of the equations of motion above includes dimensionless coefficients that tune the equations to the round type selected. The values of these coefficients are the aeroballistic coefficients of the round indexed by Mach value and solved for in each iterative step as part of the ballistics model. To simulate the flight of the projectile the state of the gun at time of fire is needed. These inputs include the altitude of the gun, the latitude of the gun, the current speed of the gun, and the gun's inertial pointing angles. For this simulation, the altitude, latitude, and speed of the gun are taken as inputs from the aircraft model 250 in Chapter III.

Section III.2.4—Model Verification and Validation: The ballistic model implemented for this research was verified and validated to ensure accuracy. The model was verified via code review and unit testing. Code inspection verified that the ballistics model 260 in the code matched the documented model. A feature added to the model enables an operator to turn on or off individual forces and moments. This facilitates unit testing of the model in a "build-up" manner; adding forces into the system and confirming that they act as expected. Testing confirmed that each force was acting as expected resulting in the motion associated with that force.

Where possible, the results were verified against theoretical results (such as when gravity is the only acting force). Testing verified that the model is correct to within the limits of the documented model and the algorithms used in its implementation. The flight path predictions made by the model were validated by comparison to other validated models. The PRODAS software has a built-in 4-DOF ballistics model 260 and support for many ammunition types. Both PRODAS and the 4-DOF model developed for this research were used to produce surface-fire range tables with the same ammunition. The predicted DR and CR impact locations matched between the PRODAS table and the one generated the 4-DOF developed for this analysis.

PRODAS is considered valid due to extensive testing and wide acceptance of the modeling suite for ballistics analysis. The research model was similarly validated against the ballistics model 260 used in tactical code for AC-130 gun-ships. The predicted final state of the round produced by the models was compared over two-thousand random starting conditions. The model developed for this research produced predicted impacts that match the tactical code's predicted impacts to within machine truncation limitations. The tactical code is considered valid due to years of successful use engaging hostile forces in combat situations and validation during testing at Dahlgren.

Section III.3—Wind Modeling: Two different wind models 240 were used in this research: a static wind model and a measured wind model. During simulation, the static wind model was used both for code development and validation and to simulate the ballistic wind that results from the current method of wind prediction in AC-130 tactical systems in Section 11.3. The measured wind model introduces dynamic winds closer to reality than the static wind model. The wind models 240 were applied to the ballistics model 260 in Section III.2 in separate simulations and modify the velocity of the round relative to the air stream in the equations of motion.

Section III.3.1—Assumptions: Both models assumed that the vertical wind speed is 0.0 m/s. The vertical winds tend to be very low so this assumption does not cause any large errors. Wind measuring systems commonly use vertical winds as a validation; low to nonexistent vertical winds are considered an indication that the measuring system is functioning as expected. Both models also assume that the winds do not change over time. Again, this is not strictly true, but for the sake of analysis the winds are held constant.

Section III.3.2—Model Description: Static winds can be generated with speed up to 100.0 m/s in any direction. The 100.0 m/s limit is close to the highest observed wind speed. This highest observed value was chosen as the limit to test the system in as broad a range as possible. The static wind column generated by the model has the same wind speed and direction at all altitudes. Measured winds are produced off of meteorological balloon data. This met balloon data is actual data that was recorded during previous testing at the Naval Surface Warfare Center, Dahlgren Va. The wind speed and direction at altitudes are modified only to add a wind speed of 0.0 m/s at the ground. For both models, the vertical winds are 0.0 m/s.

Section III.3.3—Model Factors and Parameters: The wind speed and direction of the static wind column can be set either programmatically or using configuration settings. Measured wind columns are chosen based on which set of met balloon data are to be used. Once chosen, no other user input to the wind model 240 is required.

Section III.3.4—Model Verification and Validation: The wind models 240 were validated by inspecting the results of the applied winds on the impact predicted by the ballistic model. When applying a static wind, the predicted final impact of the round moves in the direction expected and by the rough magnitude expected. One cannot directly predict how far a given wind pushes a round without using the ballistic model. The validation tests confirmed that larger wind magnitudes moved the round farther than smaller magnitude winds. The format of the data output by the wind model 240 for the measured winds was verified to match the format used by the static model. The measured winds can be applied to the ballistics model 260 and testing confirmed that the final impact was moved by the winds. Given the dynamic nature of the measured winds, one cannot validate based on direction or magnitude of the induced impact miss distance.

Section III.4—Tracker Model: The technology to track a round in flight exists. Different methods and devices exist to track the round. Regardless of the method the expected output data from a tracking system is the same. A tracking system must detect the round and provide relevant position and velocity data about the round in a relevant reference frame. The exact method of detection and measurement is not relevant to this process. Instead, what matters is the ability to use the resulting positional and velocity data. Given this, the model developed for the tracker model 270 ignores the specific methods and any idiosyncrasies they may have and focuses on the production of valid tracking data for the projectile in flight.

Section III.4.1—Assumptions: The tracker model 270 assumes that any round tracking device used in a tactical application would report the position and velocity of the round (i.e., gun-launched projectile). A real-world application of the tracker can be assumed to be a separate piece of hardware from the rest of the gun FC system. As a separate configuration item, any model meant to recreate the tracker output must be a separate software process. This controls the availability of data in the system. All data coming into or out of the tracker model 270 are controlled by defined network messages. The messages sent by the tracker model 270 are limited. Any real tracker hardware would have to share network bandwidth with other devices. This limits the size of the message that can be sent by the tracker to the wind prediction model. Attempting to send a flight path for a projectile that contains thousands of data points may bog down a network and prevent other traffic from reception. The tracker model 270 is further assumed to incorporate the full predicted ballistic flight path with winds applied. The tracker model 270 must know the entire path and then down-select the data points to produce a smaller track.

Section III.4.2—Model Description: The tracker model 270 uses the predicted flight path of the round produced by the ballistics model 260 with winds generated by the wind model 240 applied. The trajectory of the round is produced by the ballistics model 260 to a granularity controlled only by the integration time step chosen. The tracker model 270 incorporates the full trajectory to generate a "tracked" flight path.

The operator can configure the number of data points in the track. The data are then used to populate a message that is sent over a multicast network. The messages generated by the tracker model 270 contain the positions and velocities of the round in flight and the initial gun state. The initial gun state data include the ammo type, initial geographic position, aircraft speed, aircraft course, and the inertial azimuth and elevation of the barrel of the gun. Additionally, a value is included to indicate the number of tracked positions in the message. The tracker positions are included as an array of latitude, longitude, and altitude values for the number of selected data points.

Section III.4.3—Model Factors and Parameters: For the purposes of all simulation in this research the number of data points produced by the tracker model was set to ten. This number was selected to test the possible improvement seen when tracking comparatively few data points. The tracker model 270 relies on the ballistics model 260 and the wind model 240. The ballistics and wind models each have their own inputs and controls. The tracker model 270 does not control the parameters of these other models. Network messages can be sent to the tracker model 270 to produce and send tracks.

Section III.4.4—Model Verification and Validation: Model verification was performed to ensure that the tracker model would run as expected and send the network message expected. Testing confirmed that the tracker model produced an array of positions on command and sent those points in a message of the expected size to the wind prediction model. The tracker model's output was validated by inspection. Multiple ballistic flyouts were generated with random initial conditions and wind column applied. The resulting full trajectory was recorded. The trajectory was then processed with the tracker model that produced an array of points simulating the tracker results. The tracker model produced the proper number of positions as selected for each run. The positions in the tracker data were compared to the full trajectory. The tracker values matched the full trajectory values.

Section III.5—Wind Prediction Model: Wind effects on the round result in both an epistemic and aleatory error in the predicted flight path and final impact of the round. Winds pushing on the round cause the round to miss the intended target. This error is not accounted for in the initial pointing angles of the gun. Were the winds from the starting point of the round in flight to the ground perfectly known, they could be input in the ballistics model 260 and their effect could be accounted for when predicting the pointing angles needed to get a round to impact a target. The epistemic nature of the error caused by winds arises from the fact that winds are slow to change. The wind column varies over time, but the ballistic effect of the wind is generally the same over short periods of time. This has enabled successful prediction of ballistic winds in tactical applications in the past.

Section III.5.1—Assumptions: The wind column can be predicted based on the observed location and velocity of the round in flight. The model described herein assumes the absence of errors other than unaccounted for winds affecting the flight of the round. This is invalid in the real world, but the other errors tend to manifest themselves in the platform relative frame of reference whereas the wind errors manifest themselves in the world relative reference frame.

Methods exist to separate the platform relative errors from the world relative errors. Here one can assume that all platform relative errors have been accounted for, leaving only the wind induced errors. The exemplary model is not intended to solve for the true winds. Rather, the model solves for ballistic winds between the initial point and the final location used. This final location can be anywhere along the trajectory of the round including the final impact on the ground. The smaller the distance between the initial and final points, the closer the predicted wind should be to the actual winds acting on the round.

Section III.5.2—Model Description: The wind prediction model 280 predicts winds using a two-dimensional bisecting search algorithm. Using a set of initial conditions for the round and a final winded location winds are iteratively applied to the ballistics model 260 to find a set of East and North winds that push the predicted final location of the round towards the winded location. The model has predicted the correct ballistic winds when the distance between the predicted final location and the winded location is smaller than some specified distance, expressed as the closure tolerance. In various locations in this disclosure the successful termination of this search algorithm is referred to as "closure" on the solution. This means that the search algorithm has converged on to the correct answer. The search algorithm was modified for this application from its standard form. A standard bisecting search converges on the correct solution poorly when the axes of the search space are not fully aligned with the axes of the metric being closed on.

Here, the search space is defined over a range of possible East and North winds. The model searches through that space to minimize a DR and CR miss distance in the gun reference frame. The East/North winds can be rotated into the gun frame to act on the rounds as a combination of headwind and crosswind. Assuming perfect alignment of the headwind/crosswind effects on the round, then a headwind would only affect the DR portion of the projectile's flight, and the crosswind would only affect the CR portion of the projectile's flight. The total DR and CR motion of the round are not independent, however. They are cross correlated; each depending on the total time of flight of the round.

For example, a round in flight experiencing a headwind has more drag applied to it resulting in a reduced time of flight. This reduced time of flight gives the CR forces (Magnus and lift) less time to act on the round, reducing the total CR deflection even though there is no cross-wind. A bisecting search does not account for this cross-correlation. The search algorithm was modified for this application to account for the cross-correlation. The standard form of the bisecting search limits each search axis by one-half on each iteration through the search.

The modified method applies a multiplicative increase onto the resulting limited search space. This has the effect of "bumping out" the limited search space on each iteration and reduces the chance that the winded location ends up outside of the search space due to cross correlation. The wind prediction model 280 yields a ballistic wind valid for that range of altitudes between the initial and final points supplied to the model. To be employed, the closure tolerance and cross-correlation correction coefficient (CCCC) values must be set appropriately—see Chapter IV.

Section III.5.3—Model Factors and Parameters: In order to predict a wind vector, the wind prediction model 280 requires the initial state of the projectile and a final location for the projectile. The initial state of the projectile includes the following in Table 3 as 430 in FIG. 4. The search space is limited to ±100.0 m/s of wind speed in both the East and North directions. This speed is likely excessive for this analysis and any practical application. This was chosen because such values are significantly higher than almost any true winds that would be encountered. At worst, starting a search space wider than needed increases the number of iterations needed to close on the ballistic winds. In a practical application of this wind prediction model 280 the search space can be set narrower to reduce the number of calculations performed.

There is the possibility of the search algorithm failing to find a ballistic wind that can account for the observed location of the round. This can occur when the required ballistic wind exceeds the limits of the search space or if the search fails to account for the cross-correlation of the data as described above. One should prevent such a failure from occurring by properly tuning the model parameters. To further ensure that the model as coded does not continue to search for a solution without possible convergence, an explicit fifty iteration limit is imposed on the search algorithm.

Section III.5.4—Model Verification and Validation: The wind prediction model 280 was both verified and validated through extensive testing. The model was run with single-point impact data with random winds to calculate a ballistic wind for the entire wind column. Testing confirmed that the wind prediction model 280 was able to consistently predict the winds based on an input tolerance to the tweak closure. Adjusting this tolerance to require that the predicted wind-induced impact to be closer to the observed sample impact forced the wind prediction to be closer to the actual applied winds. The reverse was also observed; increasing the tolerance allowed the predicted wind to be less accurate when compared to the applied winds.

This verified that the tweak process not only found the correct wind values, but that the tolerance control applied to the tweak closure performed as expected. For some test conditions, the tweak model failed to predict winds correctly due to the cross-correlation of the data. Increasing the CCCC value enables the search algorithm to account for the cross-correlation between headwind/crosswinds and the DR/CR effect on the final impact. The details of the setting of the CCCC for the tweak closure are detailed in Chapter IV.

Chapter IV—Tuning Wind Prediction Model Parameters: After coding the models described above, values had to be chosen for the CCCC (introduced in Section III.5.2) on the wind prediction search algorithm and the wind prediction closure tolerance. The CCCC must be tuned to enable the wind prediction model 280 to correctly predict the wind speed values. As described above, a headwind acting on a round has both a DR and CR effect on the final impact. Similarly, a crosswind acting on a round affects both directions of travel. This cross-correlation can cause the wind prediction model 280 to converge to an incorrect set of wind speeds. This cross-correlation can be corrected by rotating the impact data from the DR/CR frame to a headwind/crosswind frame.

The exact nature of the rotation and value needed depends on the entire state of the round and the winds at time of fire. This calculation is complicated and assumes knowledge of the winds that the modeler would not have. A simpler solution is to increase the size of the search space on each iteration enough to cover the cross-correlation. The exact value of the CCCC was chosen to enable the wind prediction to solve for the correct wind values while still collapsing the search space quickly. Small values for the CCCC may still permit the cross-correlation to prevent the wind prediction model 280 from converging on the correct values. Large values for the CCCC might eliminate the problems caused by cross-correlation, but require more iterations of the search algorithm to complete the search due to the size of the search space after each iteration.

The wind prediction tolerance controls when the wind prediction model 280 terminates its search. This setting is a distance; provided the predicted winds permit a round to fall within the specified distance of the measured impact, then the wind prediction is said to be good and the search terminates. The accuracy of the wind prediction is controlled by the tolerance chosen. Using a large distance for the tolerance enables the predicted winds to be farther off of the actual winds. Using a small distance for the tolerance induces the predicted winds to be closer to the actual winds. But, choosing a tolerance too small causes the wind prediction model 280 to take longer to converge on the correct solution, sacrificing speed for accuracy.

Additionally, setting the tolerance to a very small value may not be practical. There is a limitation to the ability to measure the impact location of a round. For a precision on the measured impact location of ±0.1 m, then in closing to a tolerance less than ±0.1 m, the FC 290 attempts to converge to an inaccurate location. For these purposes, the round has an assumed specific diameter of 0.03 m. Closing with a tolerance of 0.015 m is sufficient to insure that the round would hit the target. Conversely, setting the tolerance to a very small value may force the wind prediction to be more stable and less susceptible to changes in state. As shown below, at shorter times of flight the tolerance has a strong effect on the accuracy of the wind prediction and its validity when used at different slant ranges. This may force the tolerance to be a smaller value than practical considerations would suggest.

Section IV.1—Simulation Description: The same type of simulation was used to tune both the wind prediction closure tolerance and the CCCC values. A stochastic simulation with 500 runs was performed. A stochastic simulation was used in this simulation to give better coverage of the possible range of flight nominals and gun state. Given the possible variations in initial state over all of the initial state variables, using a stochastic method that randomly generates the state variable values at each run helps to ensure that the testing better covers the total range of possible values.

In a real-world setting, a wind prediction system like the one modeled here would have to be able to perform under any initial conditions within an expected range. A stochastic simulation is the easiest way to recreate that type of environment. The simulation used a static wind column. The static wind column has the same wind speed and direction for all altitudes. This is not a realistic model of the wind, but the assumption is useful for testing and tuning the models. Additionally, the static wind column is a common model used to correct wind errors applied to guns. This type of wind model 240 when applied to a specific gun and round type is referred to as ballistic winds, an averaging of the effects of the real winds into a single set of wind values.

The wind speeds are randomly generated for each simulation run. The possible value for the east and north winds is taken from a uniform distribution of ±100.0 m/s. This speed limitation is based on the highest measured surface wind speed. The highest possible wind speed in this simulation is 141.4 m/s, which would be applied as a constant wind over the flight of the round. This ballistic wind is unrealistic. Category-5 hurricanes have a sustained wind speed of at least 70.0 m/s. The upper limit for the wind speed in this simulation is specifically set to exceed the maximum possible to ensure that the models are stable and valid at higher speeds. A good wind prediction model 280 should be capable of calculating wind speeds even when they fall outside of the expected range of real wind speeds. The flight nominals of the aircraft were varied randomly as well. The flight model of the aircraft and the modeling of the gun pointing reduce the number of settable variables. The values for each variable were selected from a uniform random distribution between the values shown in Table 4 as 440 in FIG. 4.

The simulation was executed as a stochastic simulation to ensure that the possible combinations of initial state were covered as well as possible. The ranges selected for all of the variables include but are not limited to those possible values see in actual gunfire missions. At each set of randomly generated initial conditions and winds a single ballistic flyout is run, creating a winded impact location. This winded impact location and the initial gun and aircraft state are then used by the wind prediction model 280 to predict a ballistic wind that accounts for the observed offset of the impact from the expected no-wind impact location. One can expect that the predicted winds to closely match the static wind model values used in each run.

Section IV.2—Initial Tuning of Cross-Correlation Correction Coefficient: Multiple sets of simulation data were collected to analyze the effect of changing the CCCC value on the wind prediction model's ability to close on the proper wind speeds. For each of the data sets the wind prediction closure tolerance was set to $10^{-16}$ m. This value was selected because it would force the wind prediction model 280 to terminate on maximum number of iterations, or fifty iterations, through the wind search space. This reduced the possibility that any errors in the wind prediction are from the closure tolerance. Any errors that are outliers from the rest of the data set are due to the cross-correlation as described above. The initial run set the CCCC equal to 1.0, meaning the wind prediction model 280 was not trying to account for the cross-correlation. The east and north winds predicted for each run are then compared to the applied winds for that run and a radial wind error is computed. That radial wind error is plotted against the time of flight for the round in each run in FIG. 5 for Radial Wind Error with CCCC=1.0.

Figure 5:
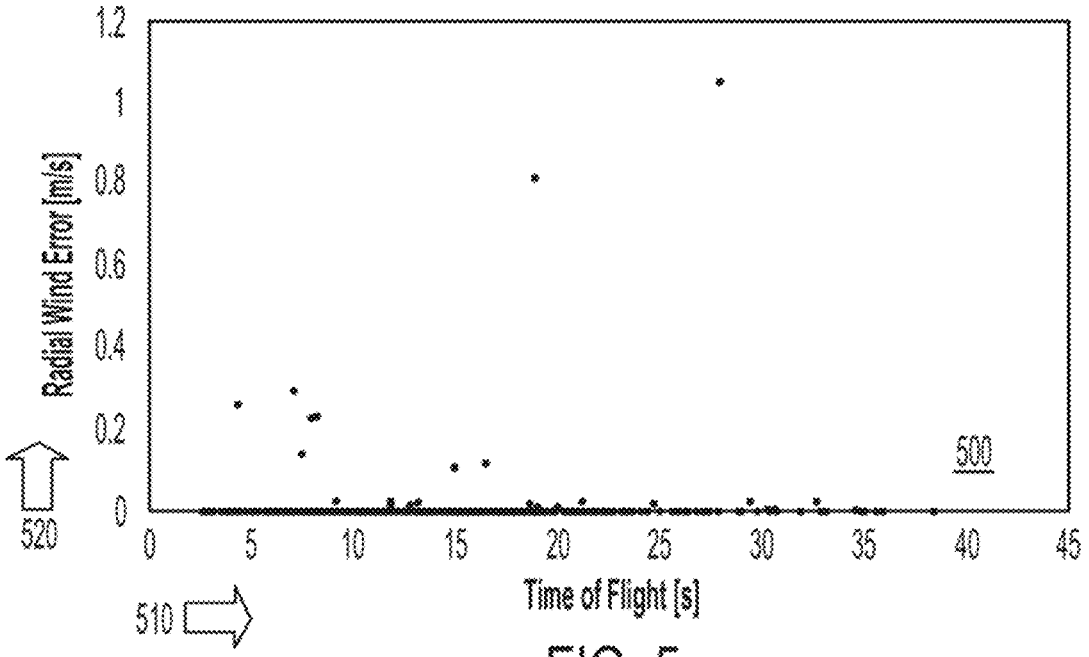
FIG. 5 is a graphical view of transient Radial Wind Error with CCCC=1.0.

In particular, FIG. 5 illustrates a graphical view 500 of transient Radial Wind Error for CCCC=1.0. Time of flight 510 in seconds (s) represents the abscissa and radial wind error 520 in meters-per-second (m/s) denotes the ordinate. Most points lie near errors less than 0.05 m/s, but several outliers approach 1.0 m/s.

Most of the runs have a very low error, so low that the scale of the plot obscures the exact magnitude. Of note are the few data points that show runs with higher radial wind errors. These errors remain after the wind predictor model had completed fifty iterations through the bisecting search algorithm. They are due to the unaccounted for cross-correlation. More data were generated increasing the CCCC value by 0.01 for each up to CCCC=1.1. Data sets for CCCC values up to 1.07 are shown in FIG. 6 as Wind errors versus time of flight at varying values of CCCC.

Figure 6:
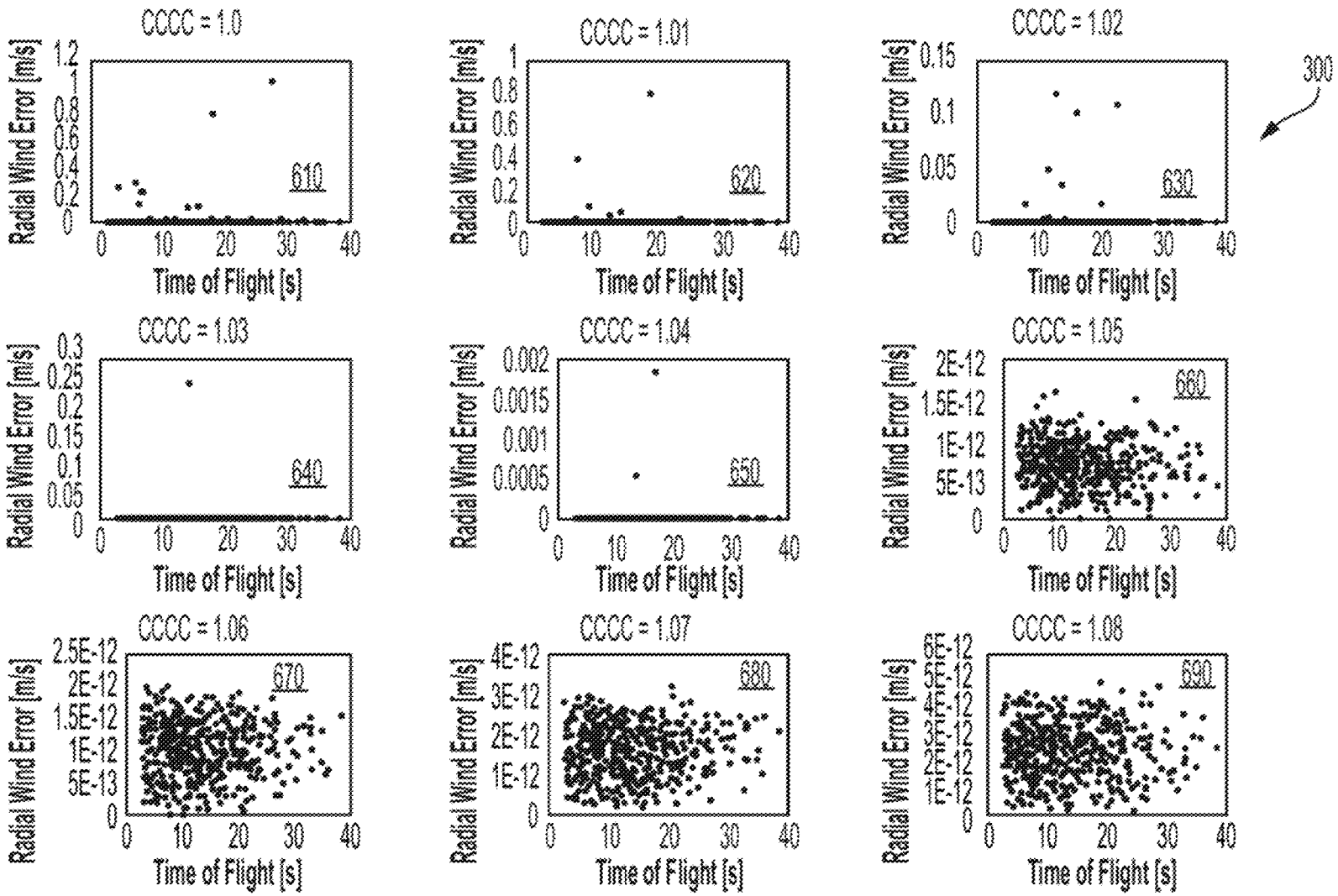
FIG. 6 is a set of graphical views of Wind Errors for different CCCC values.

FIG. 6 illustrates a graphical view 600 of Radial Wind Error plots for several CCCC values, with flight time 510 as the abscissa and radial wind error 520 as the ordinate, albeit with varying scales. For CCCC values of 1.05 and higher, the outliers have been eliminated from the radial wind errors. This indicates that the CCCC value is sufficiently high to account for the observed cross-correlation between the DR/CR impacts of the round and the headwind/cross-wind effects on the round.

Section IV.3—Tuning the Wind Prediction Closure Tolerance: The wind prediction model's closure tolerance was investigated next. The CCCC value used during the data generation for this portion was 1.1. This value is higher than the apparent lower possible value of 1.05 found in Section IV.2. The higher CCCC value was chosen for this portion of the research to ensure that the cross-correlation problem would not affect the results as the number of data points generated in each set increased. The number of data points generated in each run was increased from 500 to 5000. The simulation was run as described above and radial wind errors were calculated. An initial data set was generated with a closure tolerance of 0.01 m. The results are plotted in FIG. 7 as Radial wind errors over time of flight with closure tolerance of 0.01 m.

Figure 7:
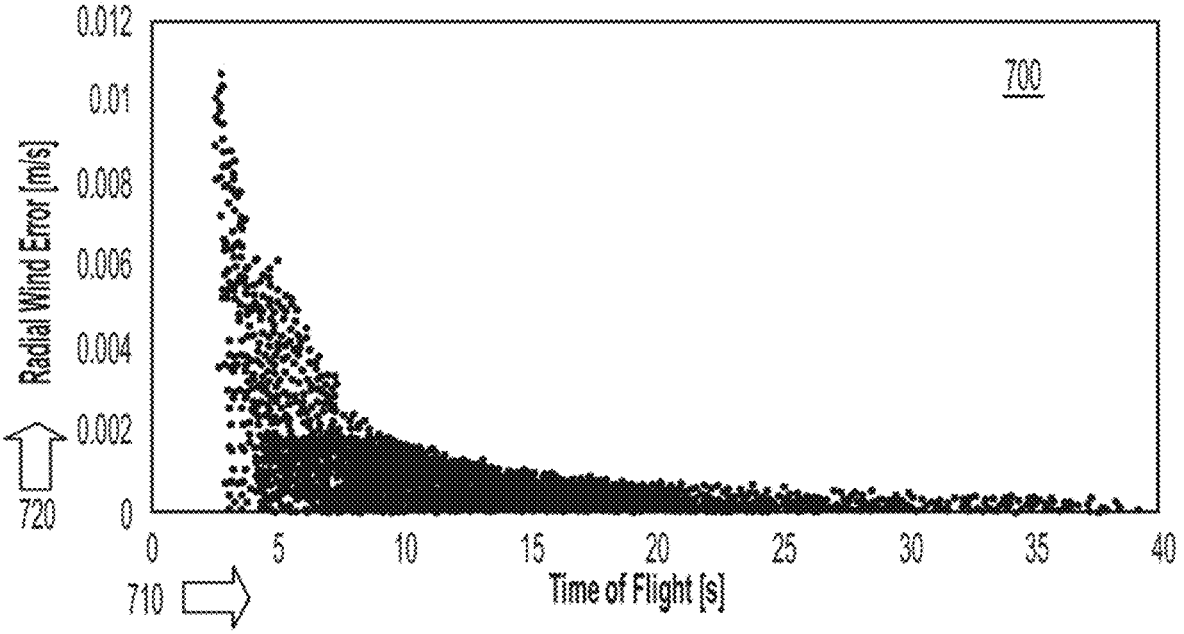
FIG. 7 is a graphical view of a Radial Wind Errors with Closure Tolerance.

FIG. 7 illustrates a graphical view 700 of transient Radial Wind Error for CCCC=1.07. Time of flight 710 in seconds (s) represents the abscissa and radial wind error 720 in meters-per-second (m/s) denotes the ordinate. The errors reach a peak near 0.01 m/s at about 2 s in flight and asymptotically decrease thereafter.

Note the shape of the curve to the data, which is expected. Consider the situation where a round is fired from a very short distance. With a low time of flight, the winds have very little time to affect the round and changes its trajectory. A round with a longer time of flight has a longer time for the winds to affect the trajectory. This means predicting winds for rounds with a longer time of flight requires more accuracy to meet a closure tolerance than such predictions would require for rounds with shorter times of flight.

This relationship established a baseline for the validity of the wind correction as the time of flight of the round changes. A prediction made based on firing at a lower time of flight can have more error in it than one made at a longer time of flight and still fall within tolerance. For a prediction made at a lower time of flight, the aircraft ascends and attempts to fire accurately using the prior wind prediction. Under these circumstances, the round might fall outside of the tolerance based only on the effects of the wind prediction errors playing out over a longer time of flight.

This simulation was repeated with varying closure tolerances and a pattern was observed. All of the data sets showed the same curved pattern as in FIG. 7. The edges of the curves for each data set were isolated and trend-lines calculated to fit the maximum edge of each of the curves. The best fit was achieved with a power curve:

$$y=ax^b, \tag{15}$$

where the fitting constants a and b, found at varying wind prediction tolerances, showed a clear relationship to each other. FIG. 8 provides tabular views 800 including Table 5 with curve-fit constants for eqn. (15) as 810 and Table 6 iteration variation with CCCC as 820.

Based on the pattern in the fitting constants a generalized equation was expressed to describe the relationship between the maximum possible wind error and the time of flight of the round that would fall within a specified closure tolerance:

$$\varepsilon_{wind} \leq 4.374563 d_{tol} \tau^{-1.36009}, \tag{16}$$

where $\varepsilon_{wind}$ is the radial wind error in meters-per-second (m/s), $d_{tol}$ is the wind prediction tolerance in meters (m), $\tau$ is the time of flight in seconds (s) and the fitting parameter values are set based on the data in Table 5 as 810 in FIG. 8. For practical considerations, the closure tolerance never needs to predict a wind that would move the round any closer to the measured impact than one-half of the width of a man-sized target. This would ensure a direct hit onto the target assuming that all other errors were accounted for at the time of fire. Based on small-arms target practice standards, the width of a man-sized target is 0.45 m.

Figure 9:
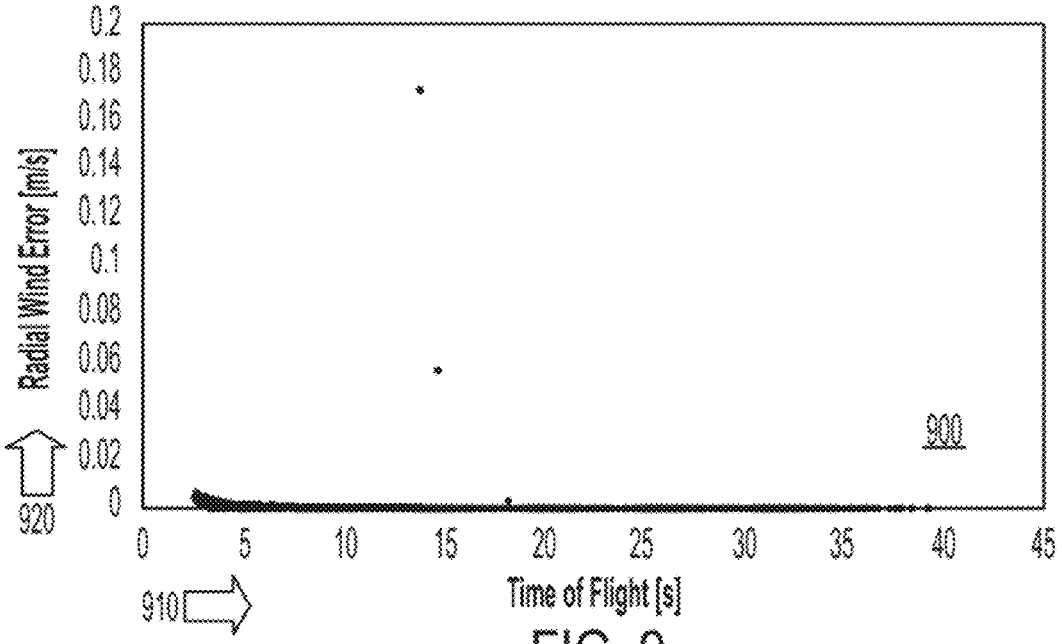
FIG. 9 is a graphical view of Outliers at CCCC=1.05.

FIG. 9 illustrates a graphical view 900 of transient Radial Wind Error for CCCC=1.05. Time of flight 910 in seconds (s) represents the abscissa and radial wind error 920 in meters-per-second (m/s) denotes the ordinate. Most errors reach remain below 0.01 m/s with scattered outliers an order of magnitude higher. The longest predicted time of flight of 40.0 s was used. Knowing the time of flight and the closure tolerance the above equation can be used to find an upper bound to the wind prediction error. This upper bound can then be used at a lower time of flight, in this case 2.5 s, to calculate a closure tolerance, given:

$$a d_1 \tau_1^{\,b} \geq \varepsilon_{wind} \leq a d_2 \tau_2^{\,b}, \tag{17}$$

$$d_1 \tau_1^{\,b} = d_2 \tau_2^{\,b}, \tag{18}$$

and $$\frac{d_1 \tau_1^b}{\tau_2^b} = d_2, \tag{19}$$

resulting in the numerical value for distance in meters:

$$\frac{(0.225) \cdot 40.0^{-1.36009}}{2.5^{-1.3009}} = d_2 = 5.182 \cdot 10^{-3} \text{ m}. \tag{20}$$

This closure tolerance, 5.182 mm, is enough to ensure that a wind prediction calculated based on shots with a time of flight of 2.5 s still results in rounds impacting within 0.225 m assuming a time of flight of 40.0 s.

Section IV.4—Final Tuning of Tolerance and CCCC: In Section IV.2, the CCCC was investigated and a range of possible values was determined. Those data showed that a CCCC value of 1.05 or larger was sufficient to remove the outliers due to cross-correlation between the head/cross-winds and the DR/CR impacts of the round when a sample of 500 data points is used. The wind prediction closure tolerance was set to a small value, $10^{-16}$ m, to ensure that the wind prediction went through as many cycles as possible.

Based on the closure tolerance tuning in Section IV.3, the CCCC was reexamined. The sample size was increased from 500 shots to 5000 shots to cover more initial states of the gun and aircraft. There may be states that were not covered with five-hundred sample shots that would show the same outliers seen with lower CCCC values. The stochastic nature of the data generation was controlled to ensure that the same states were generated for each CCCC value and that the first five-hundred states tested matched the states in the prior analyses. New data sets were generated with CCCC values ranging from 1.05 to 1.1 in steps of 0.01. The goal of the analysis involved finding a CCCC setting that eliminates the cross-correlation outliers, while minimizing the number of iterations the wind prediction model 280 executes to close to within the specified tolerance.

At each CCCC value, the number of iterations to close was recorded and compared to subsequent runs. The expectation is that larger CCCC values open the search space and lead to more iterations overall. Runs with CCCC=1.05 revealed outliers in FIG. 9 runs beyond number five-hundred. Outliers at CCCC=1.05 with five-thousand samples. These three data points indicate that a larger CCCC value is required to reduce the chances of seeing a failure to close properly due to cross-correlation. At CCCC=1.06 no outliers were apparent from the data. This held true for all CCCC values larger than 1.05 investigated. The numbers of iterations required for the wind prediction to close to within the specified tolerance at a given CCCC were compared against the number of iterations required at CCCC=1.06 in Table 6 as 820 in FIG. 8. No benefit was observed with CCCC values greater than 1.06. The number of iterations required by the wind prediction model 280 increased on average as the CCCC value increased, though the increase was small.

Section IV.5—Conclusion: Initial runs of the simulation confirmed that the wind prediction model 280 performed as expected. It was able to close on a single-point wind value to within the specified tolerance, verifying the model's functionality. Tuning tests were performed to find and set the values of the cross-correlation correction coefficient and the wind prediction closure tolerance. The CCCC was set to 1.06. This setting was sufficient to eliminate all outliers in a five-thousand sample data set. The closure tolerance was set to $5.182 \times 10^{-3}$ m. This value was selected based on the behavior of the data showing the relationship between radial errors in the wind prediction based on the time of flight of the projectile. This tolerance was selected to ensure that the effects of changes in state that would affect the time of flight of a round would induce no more than 0.225 m of possible miss distance so to poor wind prediction.

Chapter V—Single-Point Prediction of Ballistic Winds: The single-point wind prediction model 280 can be used with a constant value wind model, as shown in Chapter IV, or instead can be used against a measured wind model. When tested with a constant wind model, the wind prediction model 280 generates a wind speed and direction (or East and North wind speeds) that matches the constant wind model speed and direction to within an error tolerance based on the closure tolerance distance used in the wind prediction model 280 as described by eqn. (16).

In this chapter, single-point wind predictions are made at varying initial states using multiple measured wind models. These data are used as a baseline of current wind prediction capabilities. Subsequent sections incorporate these single-point ballistic wind predictions to compare to wind predictions made using data from a round tracking sensor.

Figure 10:
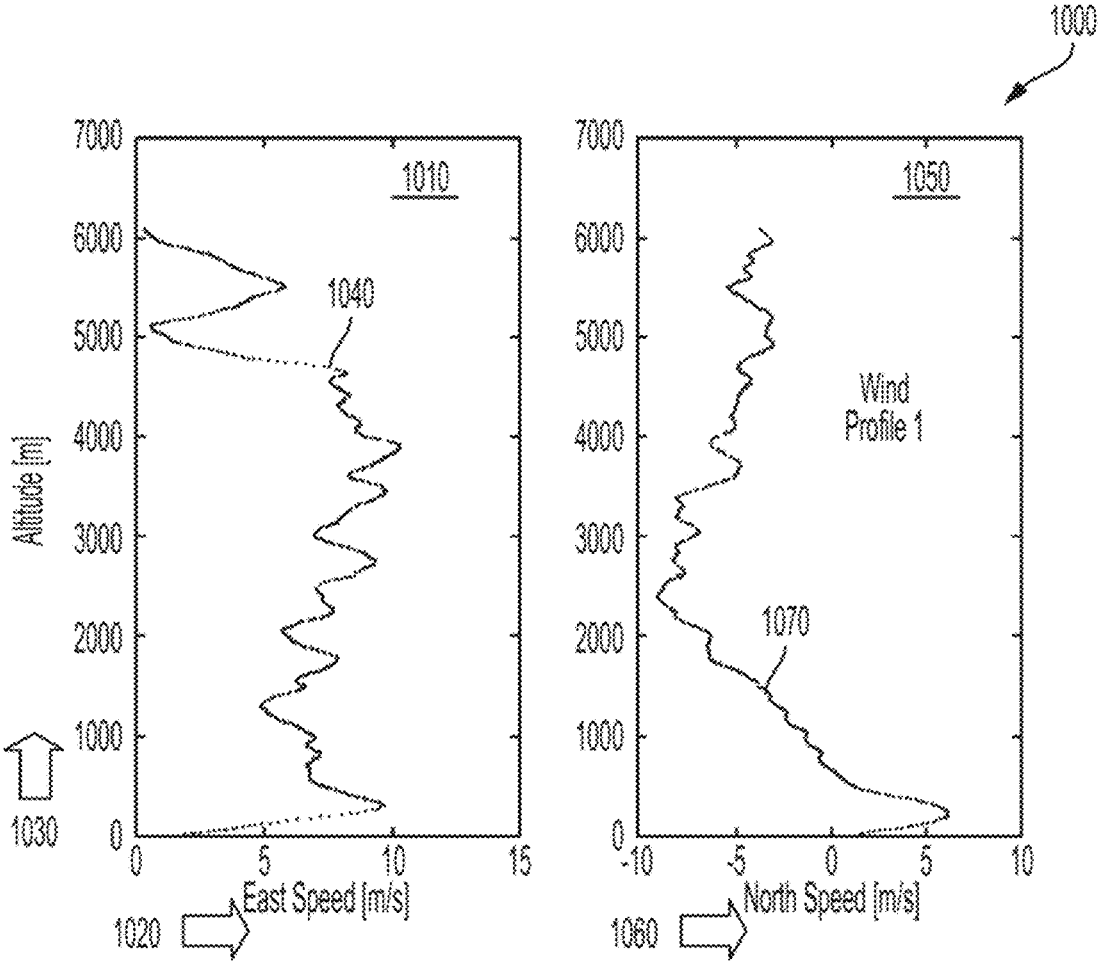
FIG. 10 is a graphical view of Wind Profile I.

Section V.1—Simulation Description: For this simulation sixteen measured winds were used as the winds applied to the round in flight. These winds were measured using a radiosonde meteorological balloon. The measurements were taken on different four different days at the Naval Surface Warfare Center at Dahlgren, Va. Wind Profile 1 provides a sample wind profile showing the East and North wind speeds with respect to altitude. FIG. 10 illustrates a graphical view 1000 of Wind Profile 1. Plot 1010 provides East wind speed 1020 (m/s) as the abscissa, with altitude 1030 in kilometers (km) as the ordinate. The staggering line 1040 shows East wind variation as altitude increases. Plot 1050 provides North wind speed 1060 (m/s) as the abscissa, with altitude 1030 in kilometers (km) as the ordinate. The staggering line 1070 shows North wind variation as altitude increases.

A stochastic simulation was run with each of the sixteen wind profiles. Each simulation consisted of ballistic impact predictions made with five-thousand different initial conditions. The gun altitude, aircraft speed, and total gun depression angle were generated for each of the runs from a uniform distribution with the limits shown in Table 4 as 440 in FIG. 4. The random number generator seed was controlled to ensure that the same five-thousand states were used with each wind profile. The five-thousand states also matched the states used in the analysis in Chapter IV.

At each of the five-thousand initial states a ballistic flyout was performed with measured winds applied. The winded impact location of the round was recorded. The initial state and the winded impact location were used by the wind prediction model 280 to generate ballistic wind that would account for the observed offset of the winded impact location from the expected no-wind impact location. The closure tolerance used for all simulation runs was $5.182\times10^{-3}$ m, as used in Chapter IV. The result is a ballistic wind that holds the same speed and direction from the ground up to the altitude of the gun at time of fire.

Section V.2—Results: The wind prediction model 280 was able to solve for a ballistic wind on all five-thousand runs for each of the sixteen measured wind profiles. This was verified in two ways: First, the total number of iterations required to close on a ballistic wind to within the closure tolerance was recorded for each run. The maximum possible number of iterations permitted by the model for each attempt at finding a ballistic wind was fifty. The minimum number of iterations used for any of the runs was ten; the maximum was twenty-two. These values are well below the maximum of fifty runs allowed.

Had the wind prediction model 280 failed to close to within the closure tolerance distance specified, then the model would have continued to iterate through the search space until the search reached the maximum number of iterations. The fact that no run ever required close to fifty iterations to complete indicates that the wind prediction model 280 successfully closed on a ballistic wind. Second, each ballistic wind prediction was tested to ensure that the resulting impact fell within the closure tolerance of the initial winded impact used as input to the wind prediction model. The ballistic wind result was applied to the round in flight and another ballistic flyout was performed. The new impact location was compared with the initially generated winded impact location and the distance between them was calculated. For all eighty-thousand data runs the distance between the new impact location and the original winded impact location was within the closure tolerance.

Displaying the results of all eighty-thousand runs is difficult. Even limiting the data to a single wind profile out of the sixteen tested profiles does not help as each profile was used to test five-thousand different initial states. To better investigate the data, one can more simply select a few ballistic wind profiles based on states at varying altitudes and plot those against the measured wind profiles. An example of the wind prediction is presented in FIG. 11 for three sample states out of the set of five-thousand for Wind Profile 1.

Figure 11:
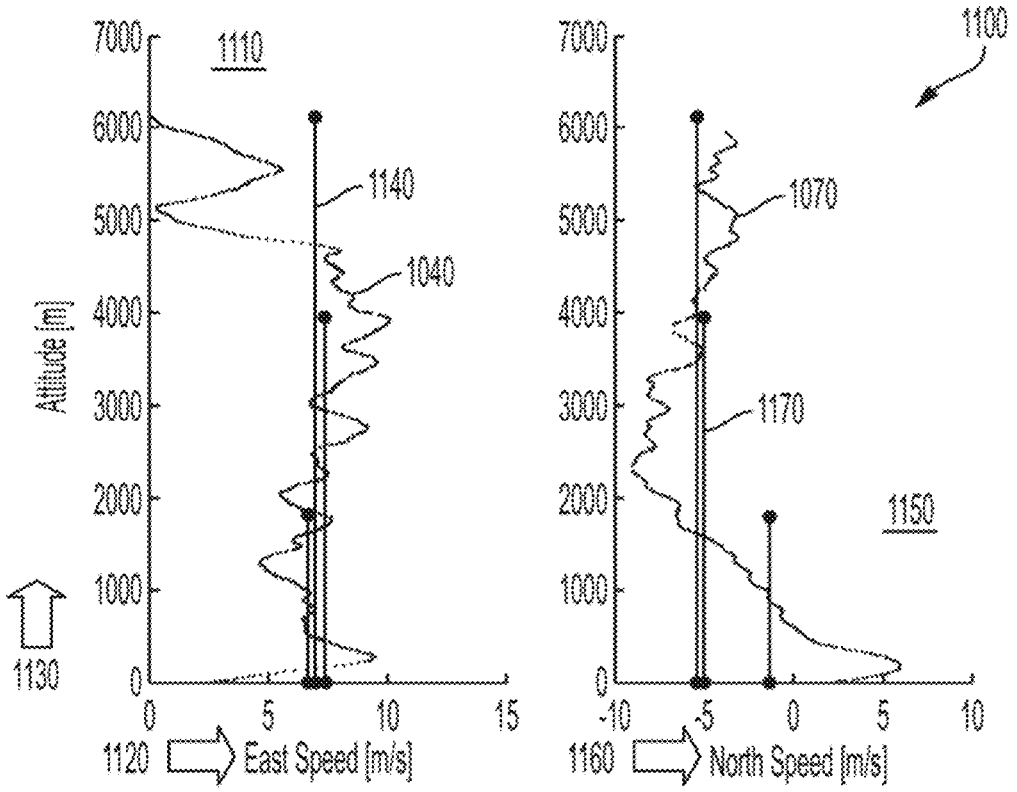
FIG. 11 is a graphical view of Model Representations for Wind Profile I.

FIG. 11 illustrates a graphical view 1100 of Three Representative Ballistic Wind with Wind Profile 1. Plot 1110 provides East wind speed 1120 (m/s) as the abscissa, with altitude 1130 (km) as the ordinate. The vertical lines 1140 terminated by dots show East wind predictions. Plot 1150 provides North wind speed 1160 (m/s) as the abscissa, with altitude 1130 (km) as the ordinate. The vertical lines 1170 terminated by dots show North wind predictions. For comparison, the staggered lines 1040 and 1070 represent the respective East and North wind speeds as measured at varying attitudes. The vertical lines 1140 and 1170 represent the ballistic wind predicted for a given simulated firing event. The East and North wind speeds are constant through the entire wind profile from the initial altitude to the ground for these ballistic winds. An inspection of the results shows that the ballistic wind profile tends to fall close to the average of the wind speeds from the starting altitude to the ground at 0.0 m.

For example, the highest altitude ballistic wind profile for the North wind speed has a value of −4.41 m/s. The average wind speed from that same altitude to the ground is −5.41 m/s. The values are close but not exact. This is expected due to the physical effects of the wind on the round, which changes based on the speed of the round. The state of the round, such as the air speed of the round, changes as the altitude decreases. The change in air speed relative to the speed of sound causes the ballistic wind diverge from the average wind speed due to the increased drag force experience in the transonic region of flight.

A visual inspection also shows that the values make intuitive sense. The measured winds have regions were wind speeds fall on either side of the predicted ballistic wind speed. This indicates that the ballistic wind profile is an attempt at balancing out the effects of the dynamic measured wind profile with a single value. The East wind speed graph has all three wind predictions grouped closely together. Visual inspection of the measured East wind shows that the wind speeds at almost all altitudes were between 5 m/s and 10 m/s. One can expect that the predicted values would fall in that band of wind speeds, which is what the results show. Plotting similar data for all five-thousand ballistic winds for a given measured wind profile would do little more than fill the graph with vertical lines. A graph that shows only the top of the ballistic wind profile is more readable. The points on such a graph in FIG. 12 five-thousand Ballistic Winds with Wind Profile 1 represent the entire ballistic wind, but are only shown at the initial altitude for the initial prediction.

Figure 12:
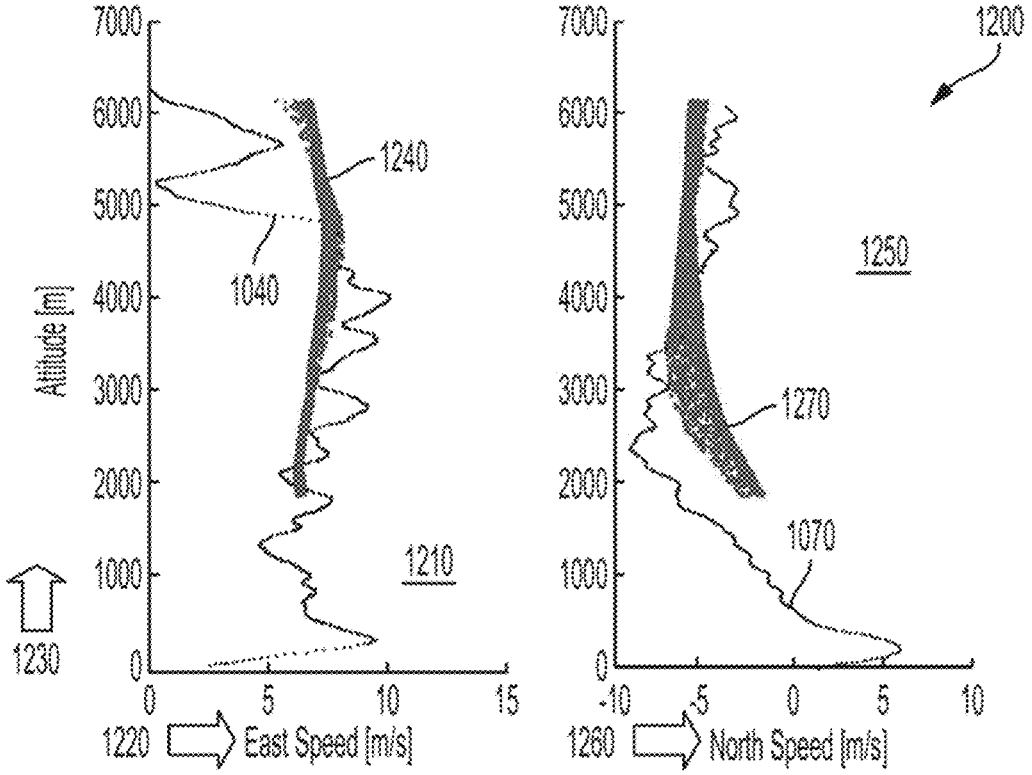
FIG. 12 is a graphical view of Ballistic Winds for Wind Profile I.

FIG. 12 illustrates a graphical view 1200 of five-thousand Ballistic Wind points with Wind Profile 1. Plot 1210 provides East wind speed 1220 (m/s) as the abscissa, with altitude 1230 (km) as the ordinate. The curved spread of points 1240 show East wind predictions. Plot 1250 provides North wind speed 1260 (m/s) as the abscissa, with altitude 1230 (km) as the ordinate. The curved spread of points 1270 show North wind predictions. For comparison, the staggered lines 1040 and 1070 represent the respective East and North wind speeds as measured at varying altitudes.

The ballistic winds are expected to change as the altitude changes. Changing the altitude of the initial fire changes the amount of atmosphere that the round flies through. The ballistic wind necessarily changes based on certain portions of the measured wind profile being included or excluded by the starting altitude. The ballistic winds are not the same at the same altitude. The spread of the points at a given altitude indicates that some factor other than altitude is causing a change in the expected wind effects on the round in flight. The gun elevation, which was also permitted to vary for the data points shown, and the dynamics of the measured wind profile itself are the factors that cause the spread in the ballistic winds at a given altitude.

Gun elevation changes the slant range to the impact location and the time of flight of the round. The measured winds have a different effect on a round that takes longer to reach the ground than on another round with a shorter time of flight. For a round fired from the same altitude, the measured winds affecting the round are the same but the state of the round varies in other ways. Rounds with a longer time of flight have a lower airspeed at each altitude than rounds with a lower time of flight. The equations of motion used to model the flight of the round depend on airspeed to calculate the forces acting on the round. Thus, even though the air column is the same for both steep and shallow shots, the round experiences those winds differently, which leads to a different prediction of the ballistic wind.

The dynamics of the measured wind also affect the spread in ballistic wind predictions. The East winds in FIG. 12 show little variation from about 5500 m to 250 m of altitude. This leads to a very narrow spread in the speeds of the predicted ballistic winds in that band of altitudes. The measured North wind speeds show more variation that leads to a greater spread in the ballistic winds at a given altitude. This same feature hold for all sixteen tested wind profiles, as can be seen in FIGS. 13 through 16.

Figure 13:
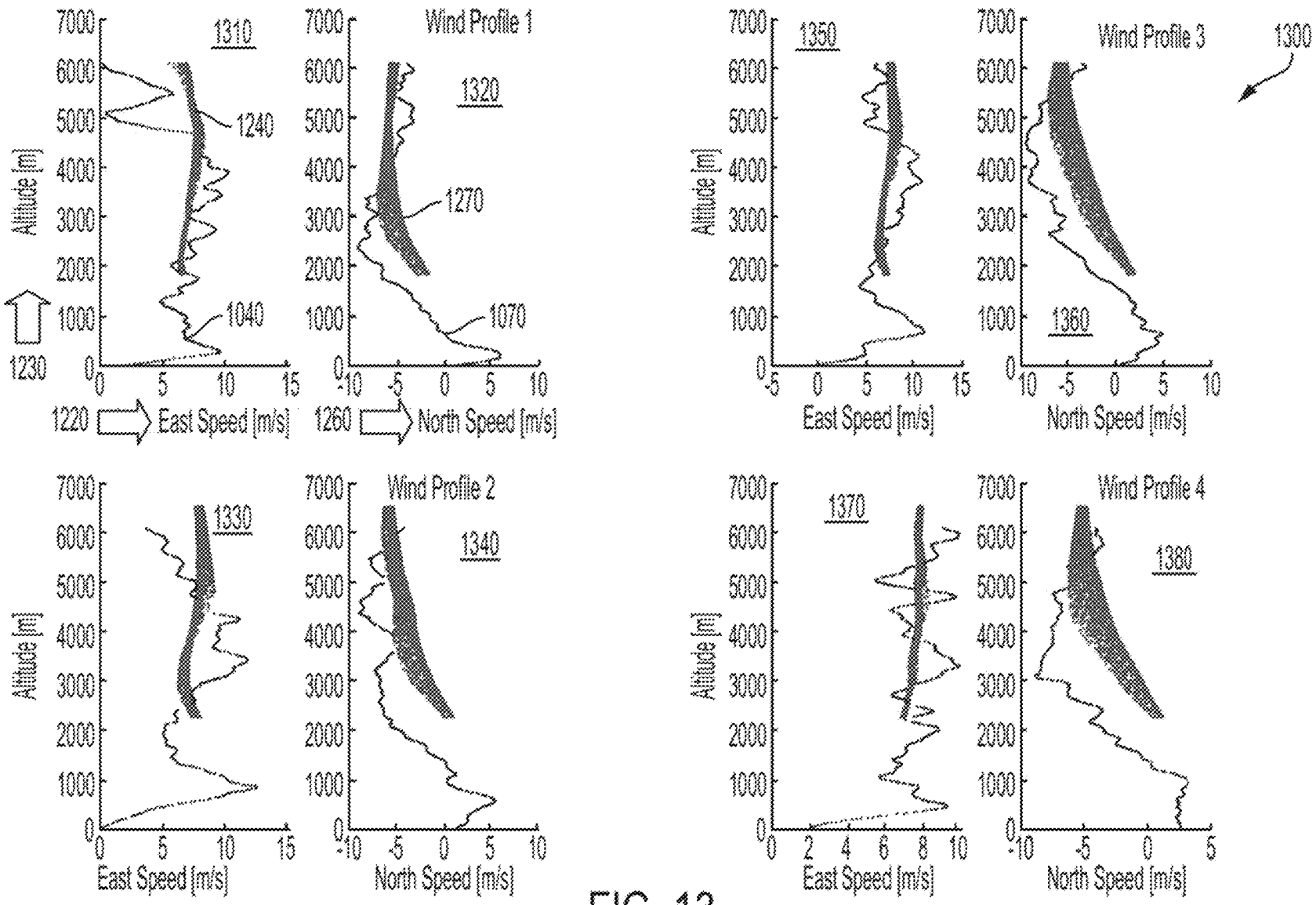
FIG. 13 is a graphical view of Wind Profiles I through 4.

FIG. 13 illustrates graphical views 1300 of East and North wind speed variations with altitude. Plots 1310 and 1320 provides East and North wind speeds for Wind Profile 1. Plots 1330 and 1340 provides East and North wind speeds for Wind Profile 2. Plots 1350 and 1360 provides East and North wind speeds for Wind Profile 3. Plots 1370 and 1380 provides East and North wind speeds for Wind Profile 4. For these four plots, the wind speed 1220 (m/s) is the abscissa, with altitude 1230 (km) is the ordinate, with the staggered lines denoting the wind velocity variation with altitude, and the curved spread denoting the ballistic wind predictions.

Figure 14:
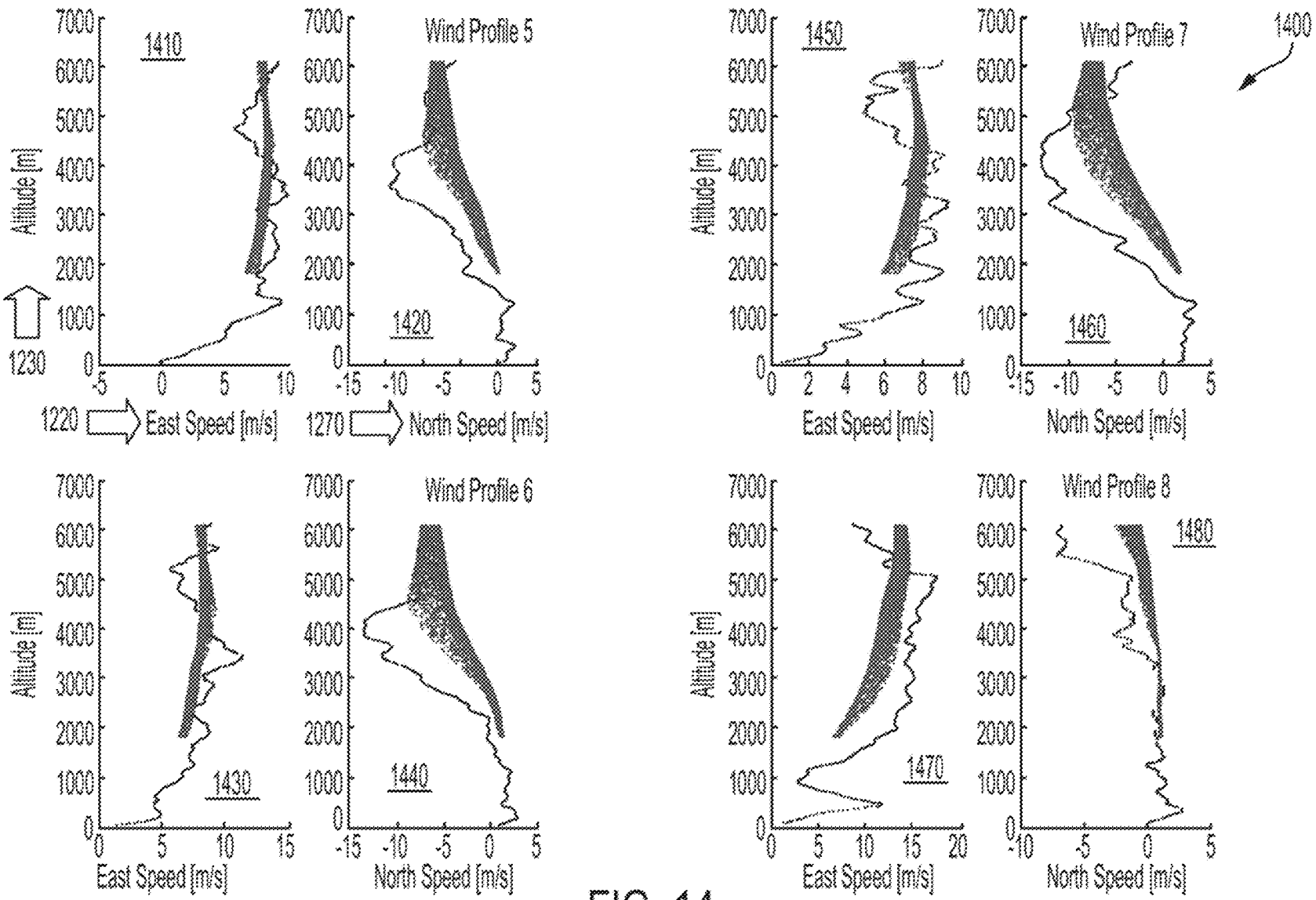
FIG. 14 is a graphical view of Wind Profiles 5 through 8.

FIG. 14 illustrates graphical views 1400 of East and North wind speed variations with altitude with similar abscissa and ordinate scales as views 1300. Plots 1410 and 1420 provides East and North wind speeds for Wind Profile 5. Plots 1430 and 1440 provides East and North wind speeds for Wind Profile 6. Plots 1450 and 1460 provides East and North wind speeds for Wind Profile 7. Plots 1470 and 1480 provides East and North wind speeds for Wind Profile 8.

Figure 15:
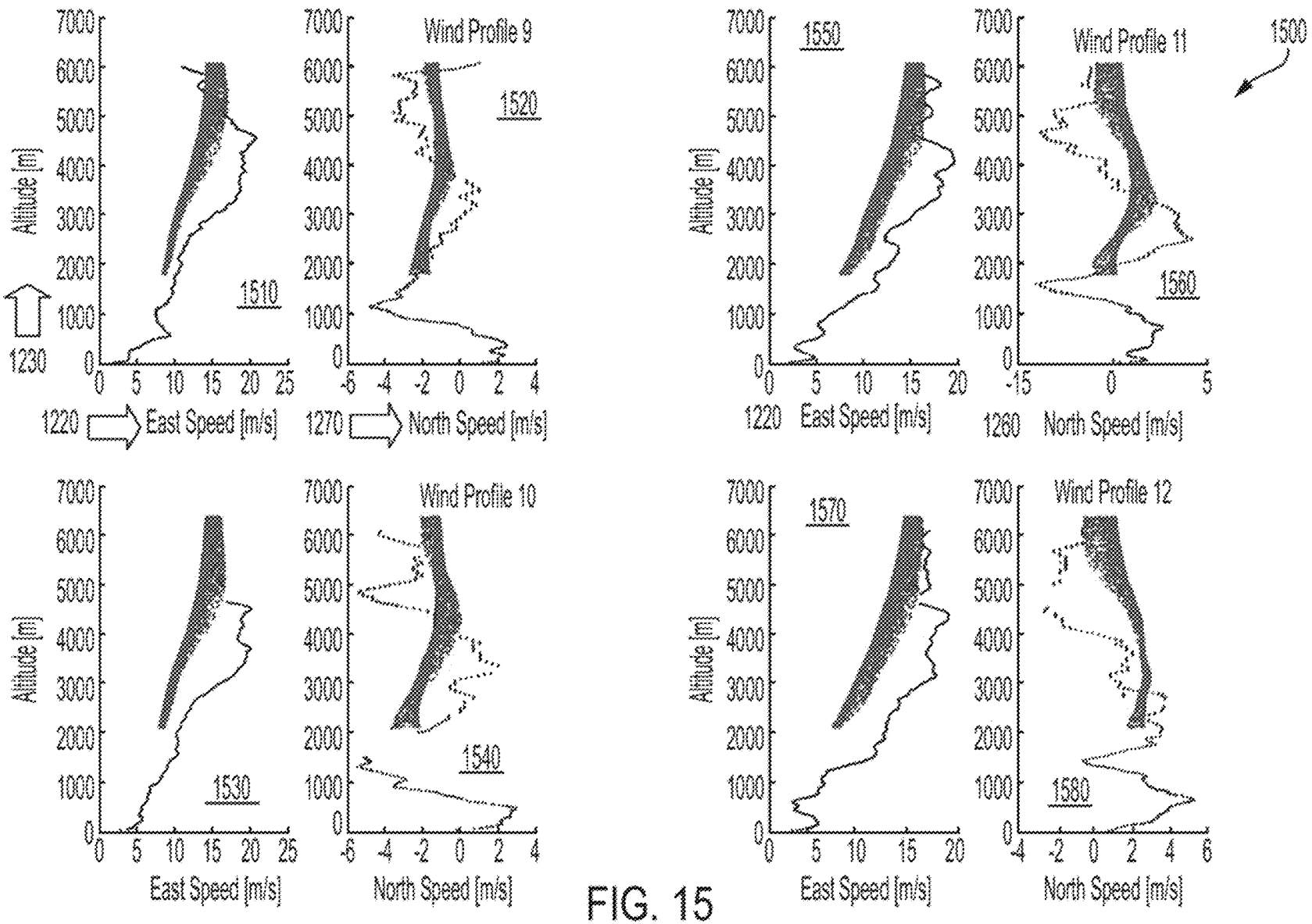
FIG. 15 is a flowchart view of Wind Profiles 9 through 12.

FIG. 15 illustrates graphical views 1500 of East and North wind speed variations with altitude with similar abscissa and ordinate scales as views 1300. Plots 1510 and 1520 provides East and North wind speeds for Wind Profile 8. Plots 1530 and 1540 provides East and North wind speeds for Wind Profile 10. Plots 1550 and 1560 provides East and North wind speeds for Wind Profile 11. Plots 1570 and 1580 provides East and North wind speeds for Wind Profile 12.

Figure 16:
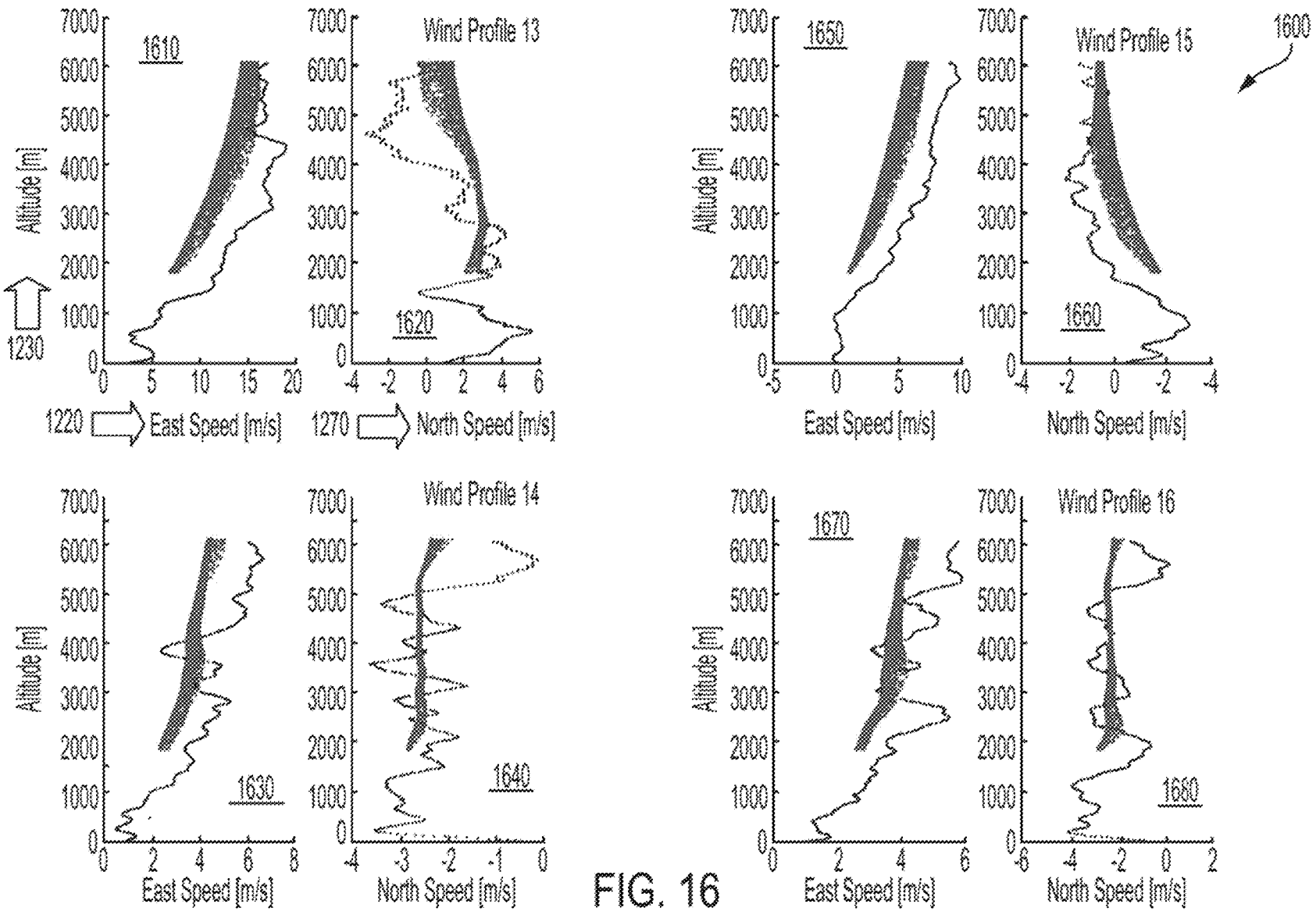
FIG. 16 is a graphical view of Wind Profiles 13 through 16.

FIG. 16 illustrates graphical views 1600 of East and North wind speed variations with altitude with similar abscissa and ordinate scales as views 1300. Plots 1610 and 1620 provides East and North wind speeds for Wind Profile 13. Plots 1630 and 1640 provides East and North wind speeds for Wind Profile 14. Plots 1650 and 1660 provides East and North wind speeds for Wind Profile 15. Plots 1670 and 1680 provides East and North wind speeds for Wind Profile 16.

Section V.3—Conclusion: From the data as described, one can deduce that the wind prediction model 280 can find a single-point ballistic wind that accounts for the miss distance when a measured wind is applied to the round. In Chapter IV the wind prediction model 280 was tested using a static wind model. Here dynamic winds based on real winds as measured by a meteorological balloon were used to induce a miss distance in the final impact. The miss distance and the initial state were used to predict a ballistic wind to correct for the cumulative effect of the measured winds.

In Chapter IV, one could expect that the ballistic winds would match the randomly generated winds to within some error metric. In this section, the ballistic winds do not match the input winds due to the nature of the wind model 240 used to generate the ballistic wind. Features of the ballistic wind were used to confirm that the results were correct. The predicted speeds of the ballistic winds are mostly controlled by the measured wind speeds used as inputs. The speeds of the ballistic wind also vary based on the state of the gun at the time of fire. The initial altitude is a strong controller. This is evident from the East and North speed predictions changing as the altitude changes. The initial altitude is not the only controller, though. The spread in ballistic wind values at a given altitude indicate that something else beyond the altitude is affecting the ballistic wind. The gun elevation, which controls the time of flight of the round, changes the state of the round at a given altitude. This difference in state leads to different interactions with the atmosphere.

The ballistic wind prediction changes based on the time of flight and the variability of the atmosphere. Based on the variations in the ballistic wind values seen in the graphs, one can expect that predictions remain valid provided the gun does not change state greatly. This is not a reasonable expectation in flight. Any state change that causes a round to have a different time of flight than the firing event used to make the wind prediction may render the ballistic wind invalid, or at the very least less valid. The data generated in this section are used as a point of comparison in subsequent sections. The results of a multipoint ballistic wind prediction method are compared to this single-point data to determine which method better models the winds and be less prone to errors induced by changes in state.

Chapter VI—Multipoint Wind Prediction: The single-point wind prediction method was shown to work as expected and make ballistic wind predictions that account for the observed wind induced miss distance to within the closure tolerance. The method can be used to predict winds under varying initial gun and aircraft states. Results from the Chapter V show that the ballistic wind speeds vary based on the initial conditions at the time of fire even when fired through the same wind column. During a live-fire event, the state of the gun and aircraft is constantly changing. This change in state may reduce the ability of the single-point ballistic wind speeds to correct for the actual wind effects.

This possibility is due to the limited number of data points being incorporated to predict the winds, using only the initial and final locations of the projectile. A method that incorporates more data, if available, is expected to generate a predicted wind that better matches the true winds acting on the round. This chapter proposes a method to model winds accurately based on increased information about the round in flight. A round tracking sensor is modeled to produce location and velocity data about the projectile. This information is used to generate a prediction of the wind speeds acting on the round. The closeness of the multipoint wind predictions is compared to the measured wind profiles. The metrics derived are then compared to similar metrics calculated using the single-point wind prediction. Based only on closeness of fit, the multipoint wind prediction method produces wind predictions that are a much closer match to the true winds than the single-point wind prediction method.

Section VI.1—Point Data Generation: The previous analysis of the single-point wind prediction only used the initial firing state and the final impact location to make a wind prediction. For the multipoint wind prediction, a round tracking sensor is modeled to provide data for the path of the round in flight. This track sensor model runs as a separate process for the simulation. This process uses the ballistics model, applying the measured winds to produce an offset impact and a full trajectory of the round in flight. Based on user configuration settings the track sensor model produces a data set with a specified number of locations and velocities for the round in flight. These data points are sent via a network message to the wind prediction model. The design and execution of the track sensor model is intended to isolate any possible information about the measured winds being applied to the ballistic model. The wind prediction model 280 has no information about the underlying winds in the system.

Section VI.2—Determining Wind Prediction Parameters: For this research the track sensor model was configured to generate data for eleven points along the flight path of the projectile. The first point is always the initial location of the round as it exits the barrel. The last point is always the impact location. The other nine data points are evenly spaced along the flight path of the round. The spacing is based on the time of flight of the round, not the distance traveled or the altitude of the round at a given point. This leads to ten intervals bounded by eleven points with the same time of flight in each interval. The number of data points chosen for the track sensor is purposefully set to a low number. The intent is to show that even with fairly sparse data, only eleven points, the wind prediction can be improved when compared to the single-point method. There is nothing to prevent further investigation with progressively larger numbers of tracked locations.

This investigation shows that improvements are seen with few data points; any extra data only further improve the wind predictions increase the overall reliability of the prediction. The multipoint method makes a wind prediction within each interval in the track data. The time of flight of the round in each interval has the potential to be much shorter than the shortest time of flight simulated with the single-point wind prediction method. As was shown in Chapter IV, the closure tolerance for the wind prediction and the time of flight of the round control the maximum possible radial wind error. This relationship is expected to hold for each interval of the multipoint wind prediction. This reduced time of flight increases the possible wind prediction error. To reduce the possible maximum wind error, the closure tolerance was reduced to 0.00001 m for all of the runs.

Figure 17:
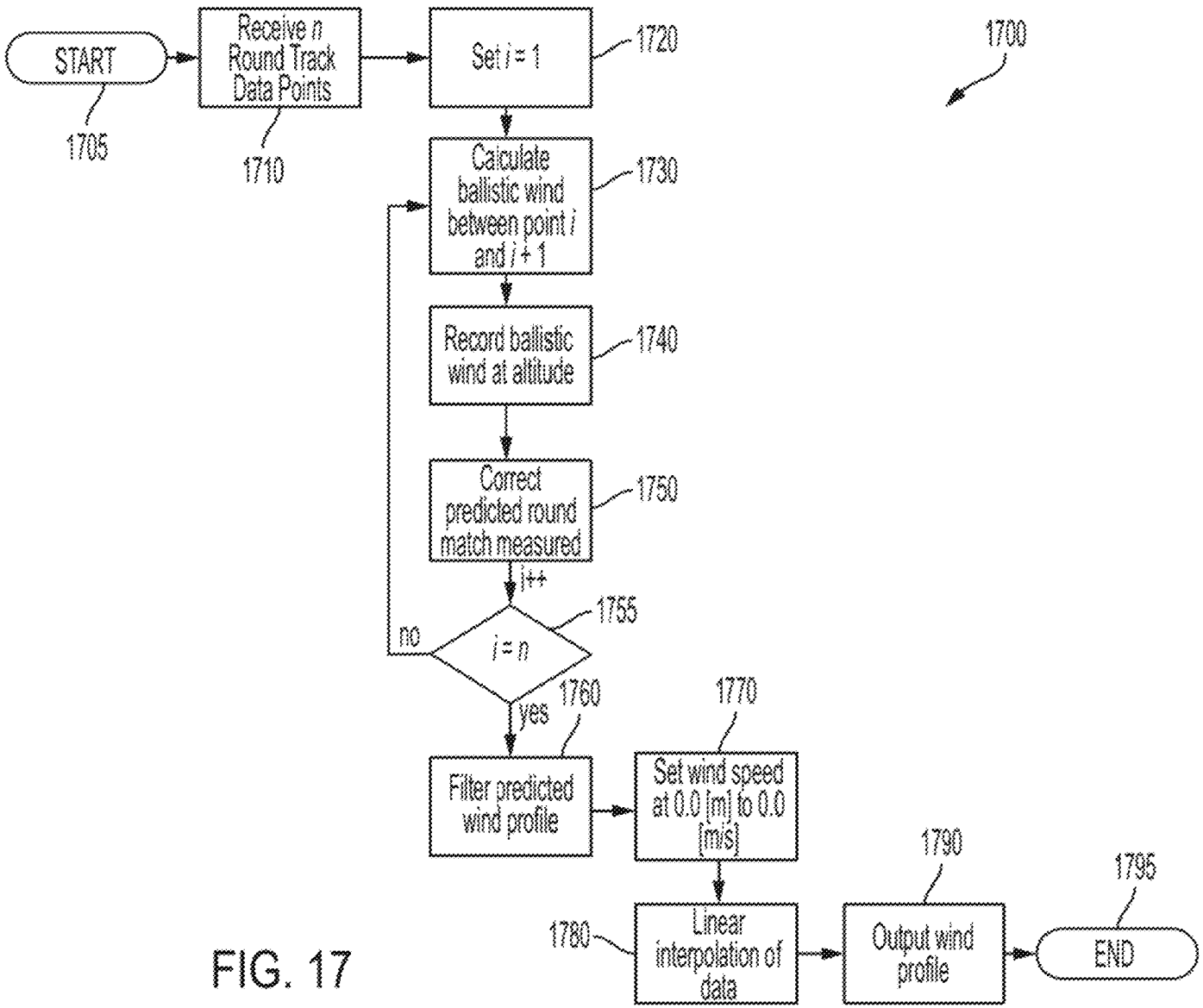
FIG. 17 is a flowchart view of a Multipoint Wind Prediction Model Architecture.

Section VI.3—Multipoint Wind Prediction Method: FIG. 17 illustrates a flowchart view 1700 of Multipoint Wind Prediction Model Architecture. The process initiation begins with start 1705, followed by receipt of round track data points 1710. This initiates process loop 1720 at an iteration interval leading to calculation of ballistic wind 1730 between the current interval and the next interval. The process continues to recordation of ballistic wind at altitude 1740, followed by correction of predicted round velocity 1750 to match measured values.

Next a query 1755 determines whether the iteration steps reach a termination value. If not, the operation returns to the calculation 1730. Otherwise, the operation proceeds to a filter predicted wind profile 1760 and then to set wind speed to zero velocity at zero altitude 1770. This follows an output wind profile 1790 and then termination 1795. The multipoint wind prediction model 280 uses the same wind prediction closure method as the single-point wind prediction. The single-point wind prediction model 280 takes into account only initial state of the gun and the final impact location to predict a ballistic wind that accounts for the wind induced miss distance. The multipoint model performs the same ballistic wind prediction but between measured points along the flight path of the round. A diagram of the algorithm used in this analysis is presented in FIG. 17.

The wind prediction model 280 receives information about the position and velocity of the round at various points along its flight path ordered by the altitude of the round from the track sensor model. Starting with the initial state of the round and gun and the first measured position of the round along its flight path, the wind prediction model 280 find a ballistic wind that accounts of the observed difference between the round location and the predicted location had there been no wind. This ballistic wind is considered to be valid only between the two points for which calculations were conducted. The wind prediction is recorded at the given altitudes. The predicted state of the round at the first measured location is used in the next iteration.

The round tracking model assumes that the position and the velocity of the round are measured, but the accelerations of the round are not known and must be predicted using the ballistics model. The position, orientation, spin rate, and accelerations of the round are taken from the ballistics model prediction at the end of the wind prediction model search. The velocity of the round is set to the velocity measured by the track sensor for the round at that location. The process continues by finding a ballistic wind that would account for the measured location between the next two points in the track data to the end of the tracked data list.

Figure 18:
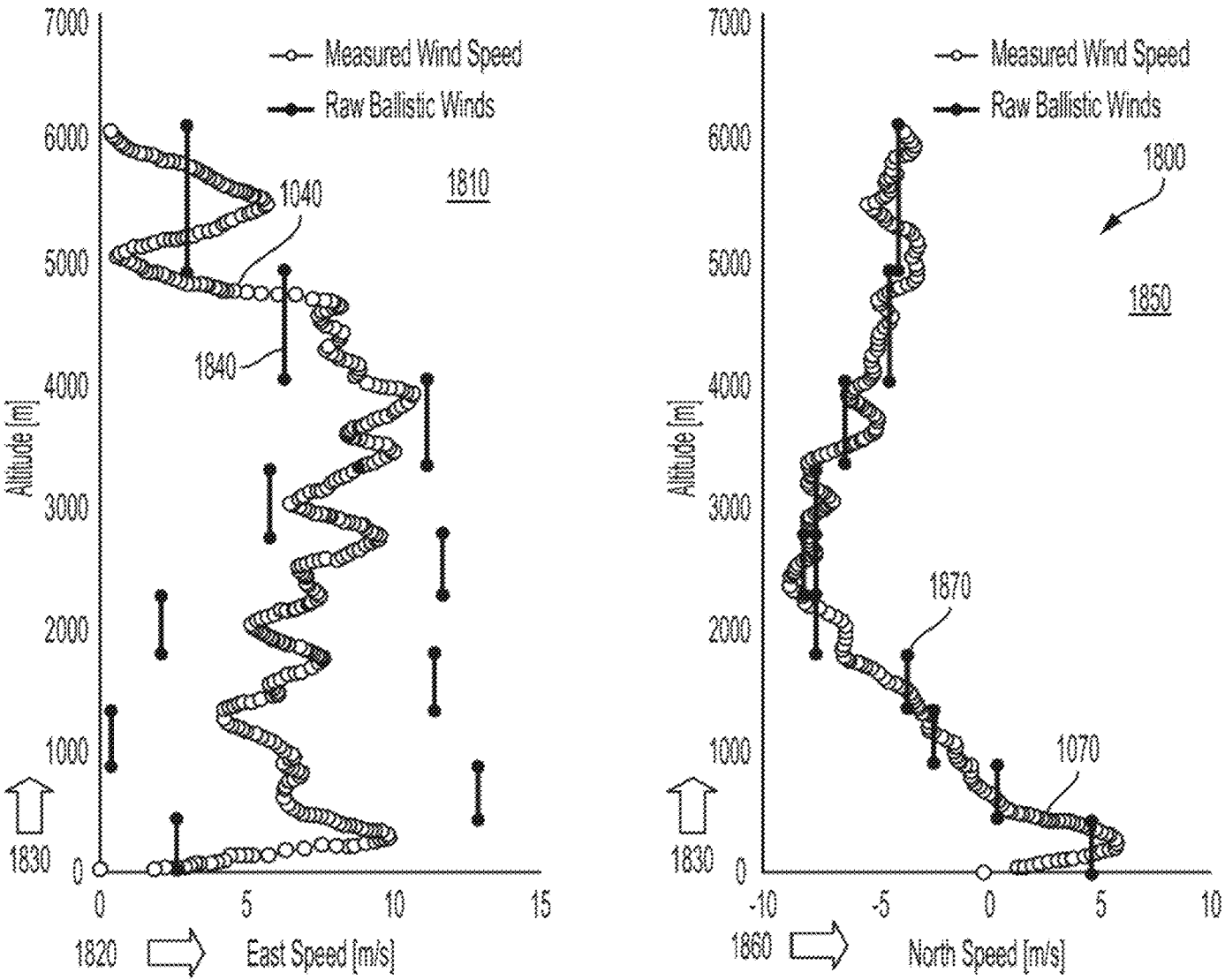
FIG. 18 is a graphical view of Initial Raw Wind Speed Prediction.

FIG. 18 illustrates a graphical view 1800 of Initial Raw Wind Speed Predictions of resulting raw data for Wind Profile 1 that require further processing. Plot 1810 provides East wind speed 1820 (m/s) as the abscissa, with altitude 1830 (km) as the ordinate. Vertical line segments 1840 terminating in dots show East wind predictions. Plot 1850 provides North wind speed 1860 (m/s) as the abscissa, with altitude 1830 (km) as the ordinate. Vertical line segments 1870 terminating in dots show North wind predictions. For comparison, the staggered lines 1040 and 1070 represent the respective East and North wind speeds as measured at varying altitudes. The predicted North wind speeds in segments 1870 fit fairly well to the real winds. The East wind speeds in segments 1840 do not appear to fit well at all. This was seen in many of the wind predictions when the applied measured winds were comparatively static. The measured wind speed data has a roughly constant overall trend from 4000 m almost until the ground. There are small oscillations in the data off of a roughly constant value, but there is no large-scale trend to the data when compared to the North wind speed data.

The wide oscillations seen in the raw ballistic winds in the East direction are an artifact of the prediction error expected. The time of flight between the data points is small, enabling the wind prediction model 280 to have a high error in the predicted ballistic winds in a given interval. This wind error changes the accelerations in the state of the round at the end of that interval. The error in the accelerations and slight error in position allowed for by the closure tolerance with both affect the wind prediction in the next interval. Assuming the actual winds acting on the round do not change largely in the following interval, the wind prediction model 280 will "chase" the errors in the acceleration and position and overcompensate for the effects of the wind in the wrong direction. This effect compounds over time leading to the large oscillations observed. Once the entire path of the round has been processed for raw ballistic wind predictions, the data are filtered.

Figure 19:
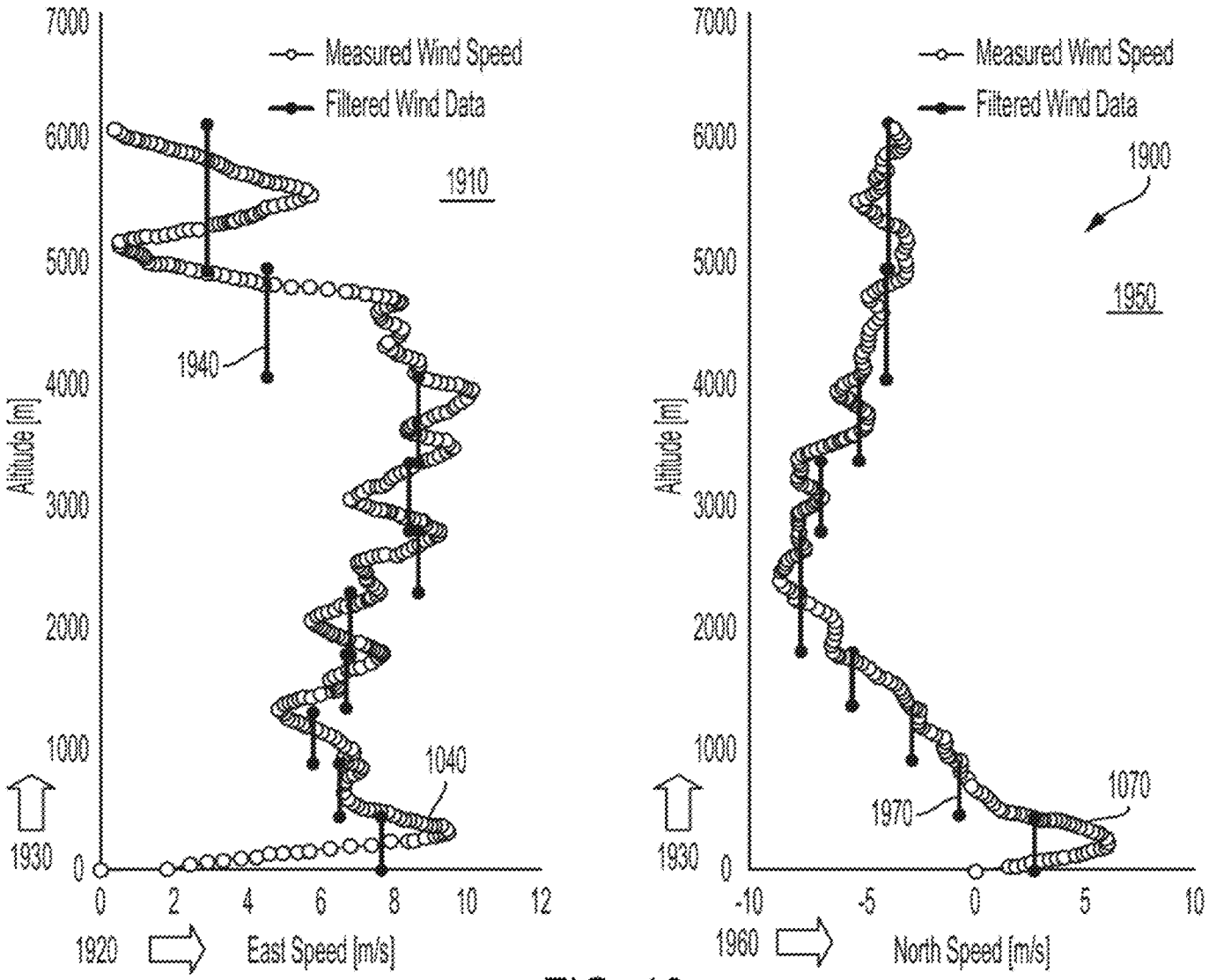
FIG. 19 is a graphical view of Filtered Wind Speed Prediction.

In the disclosed research, the data were analyzed through a running average filter with a sliding window of two data points. FIG. 19 illustrates a graphical view 1900 of Filtered Wind Speed Predictions for Wind Profile 1. Plot 1910 provides East wind speed 1920 (m/s) as the abscissa, with altitude 1930 (km) as the ordinate. Vertical line segments 1940 terminating in dots show East wind predictions. Plot 1950 provides North wind speed 1960 (m/s) as the abscissa, with altitude 1930 (km) as the ordinate. Vertical line segments 1970 terminating in dots show North wind predictions. For comparison, the staggered lines 1040 and 1070 represent the respective East and North wind speeds as measured at varying altitudes. This filter eliminates the oscillation seen in the predicted values for the East wind speed in segments 1940. The wind speed at ground level was set to 0.0 m/s. Though the winds immediately above the ground level may be non-zero at the ground, there is no wind.

The last step in processing the raw ballistic winds into final form is to assume that the wind speeds are linearly interpolated between the actual data points. From the graphs one can assume that the wind speed is constant from the initial point in the interval to the end of the interval. The ballistic wind then immediately jumps to the single value of the next interval. Instead, one can assume that the ballistic wind speed predicted only applies at the start of an interval. The wind speed at the end of each interval is assumed to be the wind speed at the start of the next interval. Any values between these points are modeled using a linear interpolation between the points as shown in FIG. 20—Final Multipoint Wind Prediction.

Figure 20:
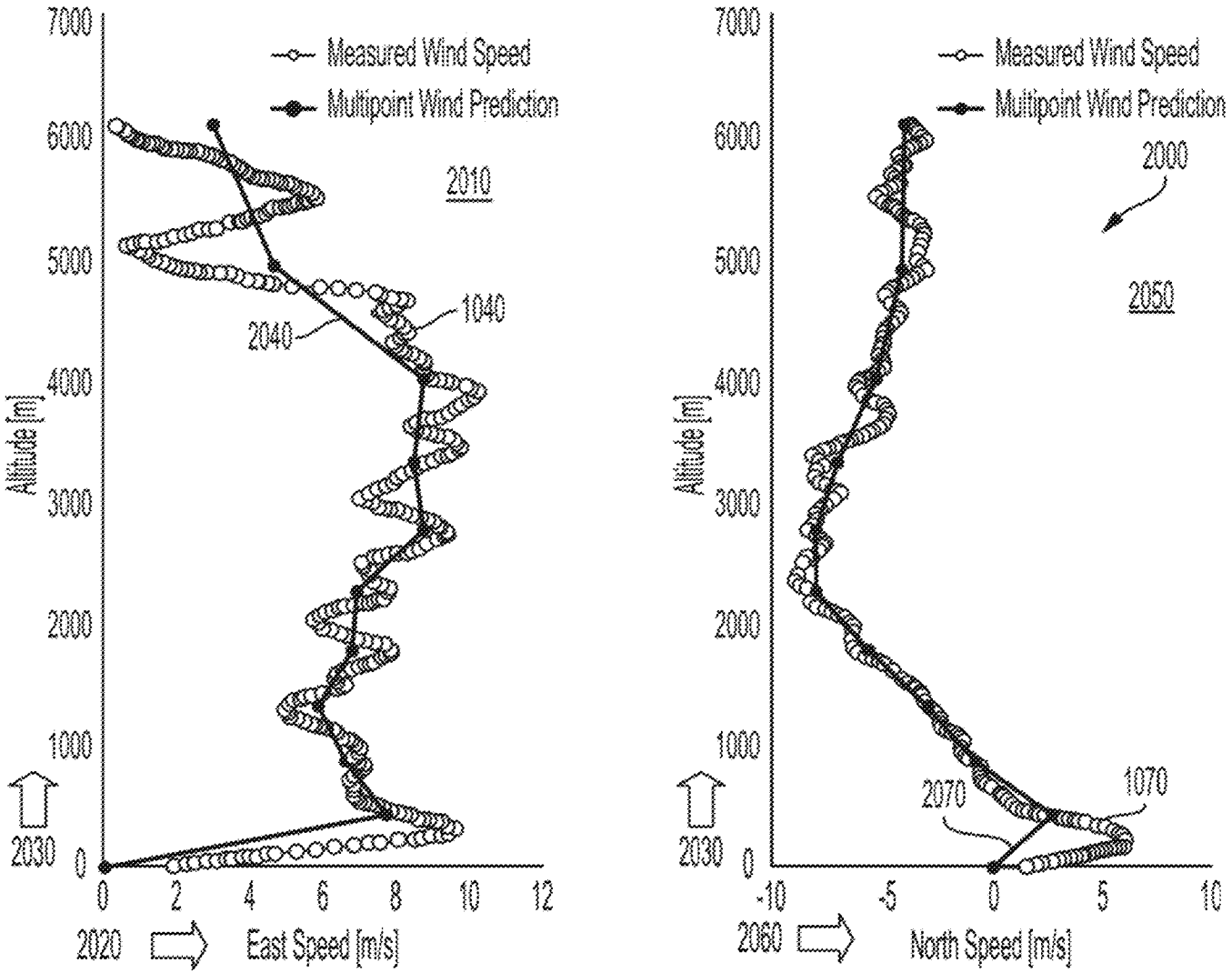
FIG. 20 is a graphical view of Final Multipoint Wind Prediction.

FIG. 20 illustrates a graphical view 2000 of Final Multipoint Wind Prediction for Wind Profile 1. Plot 2010 provides East wind speed 2020 (m/s) as the abscissa, with altitude 2030 (km) as the ordinate. Contiguous multipoint line 2040 connected by dots show East wind predictions. Plot 2050 provides North wind speed 2060 (m/s) as the abscissa, with altitude 2030 (km) as the ordinate. Contiguous multipoint line 2070 connected by dots show North wind predictions. For comparison, the staggered lines 1040 and 1070 represent the respective East and North wind speeds as measured at varying altitudes.

Section VI.4—Simulation Description: The simulation was performed similar to the previous sections. A set of five-thousand random initial states were generated and incorporated. The random seed for these five-thousand states was controlled to ensure that the states would match previous runs and would be the same for each of the wind profiles used. For each of the five-thousand initial states, a measured wind profile was applied and the ballistic model was then used to generate an impact location. This was repeated with all sixteen measured wind profiles.

The Monte Carlo nature of the simulation, with five-thousand randomly generated initial states, was selected to ensure that the possible range of states was covered with a reduced chance of biasing results based on selection of initial state. To limit the initial states to a possible subset of states or to do a parametric search through the allowed ranges of the initial state variables may cause the analysis to miss some aspect of the system. By performing a stochastic analysis the chances of missing an effect due to excluding a combination of initial state values via a strictly controlled selection process is reduced.

For each initial state, the full track of the projectile was recorded from the ballistics model 260 and input to the track sensor model. From this track data, ten evenly spaced points along the path are selected that, with the initial location of the round at time of fire, form the eleven points used to make the ballistic wind prediction. The spacing of these points was controlled by the total time of flight of the round, dividing the total time into ten evenly spaced segments with the tracked points making up the end points of those segments. The points were not selected based on altitude or position. For each of the five-thousand random runs with a given measured wind profile a multipoint ballistic wind profile was generated using the setting referenced in Section VI.2 and using the method described in Section VI.3.

Section VI.5—Results: With five-thousand initial states and sixteen different wind profiles, eighty-thousand individual runs were completed. All eighty-thousand runs completed successfully, producing ballistic wind profiles that account for the measured winds and correct the impact miss distance to within the specified closure tolerance.

Section VI.6—Analysis of Results: The goal of this research is to investigate the efficacy of wind predictions made using multiple measured locations along the flight path of the round. The best manner to judge a predicted ballistic wind is to apply the results in a simulated ballistic flyout to determine whether or not the ballistic winds correct for the observed impact miss distance. The wind prediction model 280 already accounts for this kind of analysis. The ballistic wind prediction is controlled by the closure tolerance. Wind predictions are checked at time of calculation to ensure that they generate an impact within the closure tolerance when applied to a ballistic flyout. As a check on the multipoint wind prediction compared to the single-point, the fit of the wind model to the measured winds can be used as an analog to the correctness of the wind prediction.

A perfect wind prediction model 280 would match the measured winds exactly. Expectation of perfect matching by a modeled wind profile to match the measured winds is not practical. One can reasonably expect that a valid ballistic wind model matches the true winds closely. The closeness of fit is measured by examining the standard deviation of the predicted wind model 240 off of the measured wind speeds at all altitudes. The standard deviation metric was calculated for both the single-point results and the multipoint model results for all five-thousand initial states. The results for each of the sixteen different wind profiles were kept separate. Using the above wind prediction as an example and comparing to the single-point wind prediction, the differences and quality of fit are visually apparent in FIG. 21—Comparison of Single-point and Multipoint Models.

FIG. 21 illustrates a graphical view 2100 of Comparison of Single-point and Multipoint Models similar to view 2000 for Wind Profile 1. Plot 2110 provides East wind speed 2120 (m/s) as the abscissa, with altitude 2130 (km) as the ordinate. Vertical line 2140 denotes a single-point East wind prediction. Plot 2150 provides North wind speed 2060 (m/s) as the abscissa, with altitude 2130 (km) as the ordinate. Vertical line 2170 denotes a single-point North wind prediction. For comparison, the multipoint lines 2040 and 2070 connected by dots show the respective East and North wind predictions, and the staggered lines 1040 and 1070 represent the respective East and North wind speeds as measured at varying altitudes. The multipoint lines 2040 and 2070 follow respective the staggered lines 1040 and 1070. The measured wind speeds applied to the round in flight follow more closely than the single-point values.

There are variations in the measured winds that are not captured by either of the wind prediction methods. This is a limitation caused by the use of only ten data points along the trajectory of the round. To provide, a quantitative measure of the closeness of the predicted data to the actual data, the difference between the measured wind speed and the predicted wind speed was calculated at each included altitude in the measured wind speed for both wind prediction methods and in both the East and North directions.

Figure 22:
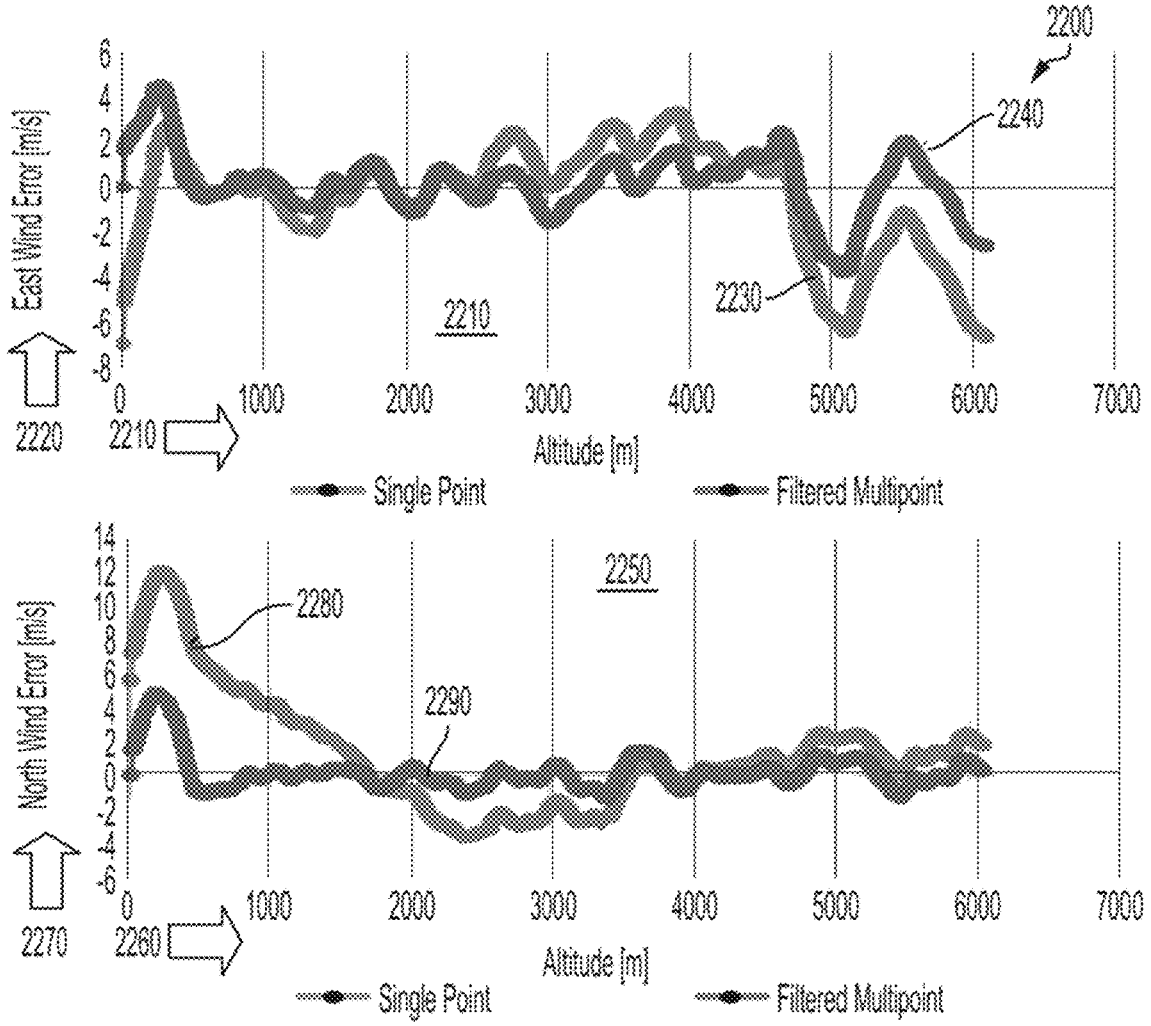
FIG. 22 is a graphical view of a Modeled Wind Errors Off of Measured Winds.

FIG. 22 illustrates graphical views 2200 of Modeled Wind Errors Off of Measured Winds. East wind plot 2210 shows altitude 2210 (km) denoted by the abscissa and East wind error 2220 (m/s), with trace predictions for single point 2230 and filtered multipoint 2240. North wind plot 2250 shows altitude 2260 (km) denoted by the abscissa and East wind error 2270 (ms), with trace predictions for single point 2280 and filtered multipoint 2290. For both East and North wind directions, single-point trace predictions feature higher errors than filtered multipoint traces, but otherwise follow in similar manners.

The standard deviations of the residuals, shown in FIG. 22—Modeled Wind Errors Off of Measured Winds, were calculated to test the goodness of the fit of the predicted winds to the measured winds. For the East winds, this single-point wind prediction 2230 had a standard deviation of 2.44 m/s, and the multipoint wind prediction 2240 had a standard deviation of 1.38 m/s. For the North winds the single-point wind prediction 2280 had a standard deviation of 3.28 m/s, and the multipoint wind prediction 2290 had a standard deviation of 0.973 m/s. The multipoint wind prediction 2290 has a lower standard deviation that the single-point wind prediction 2280, indicating that the data multipoint prediction move closely matches the measured winds.

FIG. 23 provides a tabular view 2300 including Table 7 with East wind prediction standard deviations as 2310. FIG. 24 provides tabular views 2400 including Table 8 North wind prediction standard deviations as 2410 and Table 9 state variables and distributions as 2420. Tables 7 and 8 compare minimum, mean and maximum standard deviations for single-point and multipoint winds in relation to their respective wind directions.

This same metric was calculated for all five-thousand wind predictions made with all sixteen measured wind sets shown in FIGS. 13 through 16. The results are summarized in Tables 7 as 2310 in FIG. 23 and 8 as 2410 in FIG. 24, respectively. For all sixteen measured wind profiles, the multipoint wind predictions had a lower standard deviation off of the measured winds than the single-point wind predictions. This indicates that the multipoint wind prediction provides results as expected; that the winds predicted by the multipoint method more closely match the true underlying winds. One can expect that a wind prediction that more closely matches the true winds would be more stable for predicting impact locations as the initial state of the system changes.

Section VI.7—Changing State: An additional simulation was performed to compare the results of the single-point ballistic wind prediction to the results of the multipoint ballistic wind prediction as the state of the aircraft and gun are changed from the state in which the prediction was made. A random set of fifty initial states for the aircraft and gun were chosen. A single-point and multipoint ballistic wind profile was predicted using those fifty initial states with all sixteen measured wind profiles.

The process changed the initial state of the gun and simulated a ballistic flyout. The aircraft altitude, speed, and total gun depression were allowed to vary based on a uniform random distribution with bounds detailed in Table 9 as 2420 in FIG. 24. Because the assumption that changes in the state of the aircraft and gun tend to cluster around the initial state is unwarranted, a uniform continuous distribution was selected to model these variations. The uniform distribution offers an equal probability of occurrence to all values in the range specified and does not favor values closer to the initial state.

Monte Carlo simulation was preferred over parametrically stepping through the ranges for each state variable because the effects of coupling between the state variable and the ballistic winds are not known. A parametric search could miss an effect from incorrect value selection. The measured winds were applied, and an impact location was generated. This impact was treated as "truth" data. Similar impacts were generated using both the single-point and the multipoint ballistic wind model. The state of the gun and aircraft was then changed and the data generation repeated to collect a total of one-hundred impacts around the original state where the ballistic winds were calculated. After all one-hundred variations off of the original state had been used, a new original state was selected along with the single-point and multipoint ballistic wind profiles for that state. The process was repeated for each original state, generating one-hundred variations off of the original state.

Section VI.7.1—Results: To analyze the usefulness of a ballistic wind as the state changes, the total magnitude of the impact miss distance was calculated. The impact location predicted using the measured winds was compared to the impact location predicted with the ballistic wind and a difference was calculated in the DR and CR directions to find a miss distance. The DR component of the miss distance was converted to be normal to the line-of-sight from the gun to the target. This eliminates the skewing of the impact data in the DR direction due to conic projection to the simulated surface of the Earth. The DR and CR miss distances were then converted to an angular miss instead of a linear miss distance.

Figure 25:
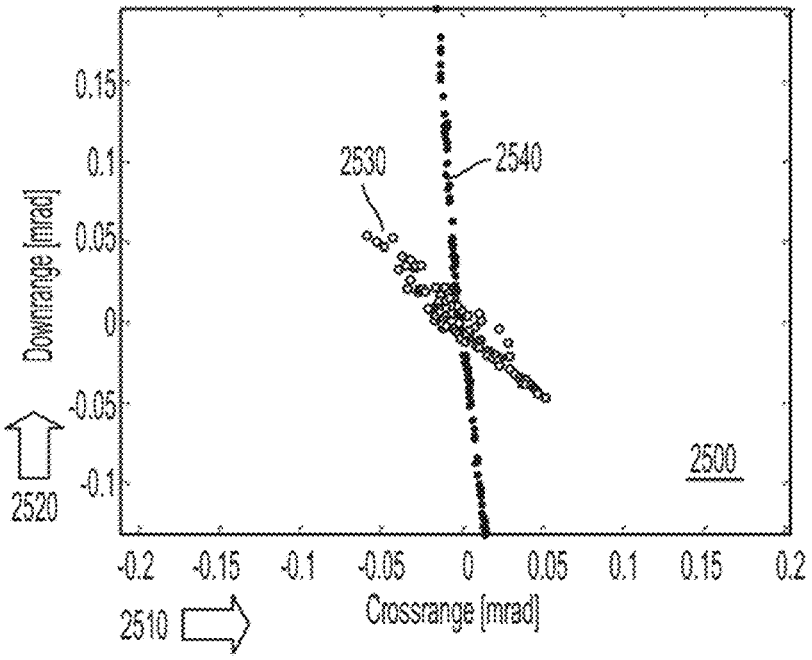
FIG. 25 is a graphical view of Example Impact Dispersion.

FIG. 25 illustrates a graphical view 2500 of Example Impact Dispersion under varying states, showing the resulting data for one initial state and wind profile. The diagonal scatter impacts 2530 are based on the multipoint ballistic wind and the near vertical scatter impacts 2540 are based on the single-point. The DR and CR angular miss distances were then combined into a single radial miss distance. For this analysis, the direction of the miss is less important than the total distance. For a given original state, the maximum radial miss distance for a given ballistic wind method out of the hundred varied states was found. The radial miss distance for the single-point and multipoint ballistic winds were compared to find which method had the lowest radial miss distance under the same change in state. As expected, the multipoint ballistic wind, with its closer fit to the measured wind, has less miss distance induced by a changing state than the single-point ballistic wind.

Section VI.7.2—Analysis of Results: Testing one-hundred changes in initial state for each of the fifty initial states using all sixteen wind profiles resulted in eight-hundred different maximum radial miss distance for the single-point and multipoint ballistic wind profiles. A histogram was generated to see what the predicted distribution of miss distances was for each ballistic wind prediction method.

Figure 26:
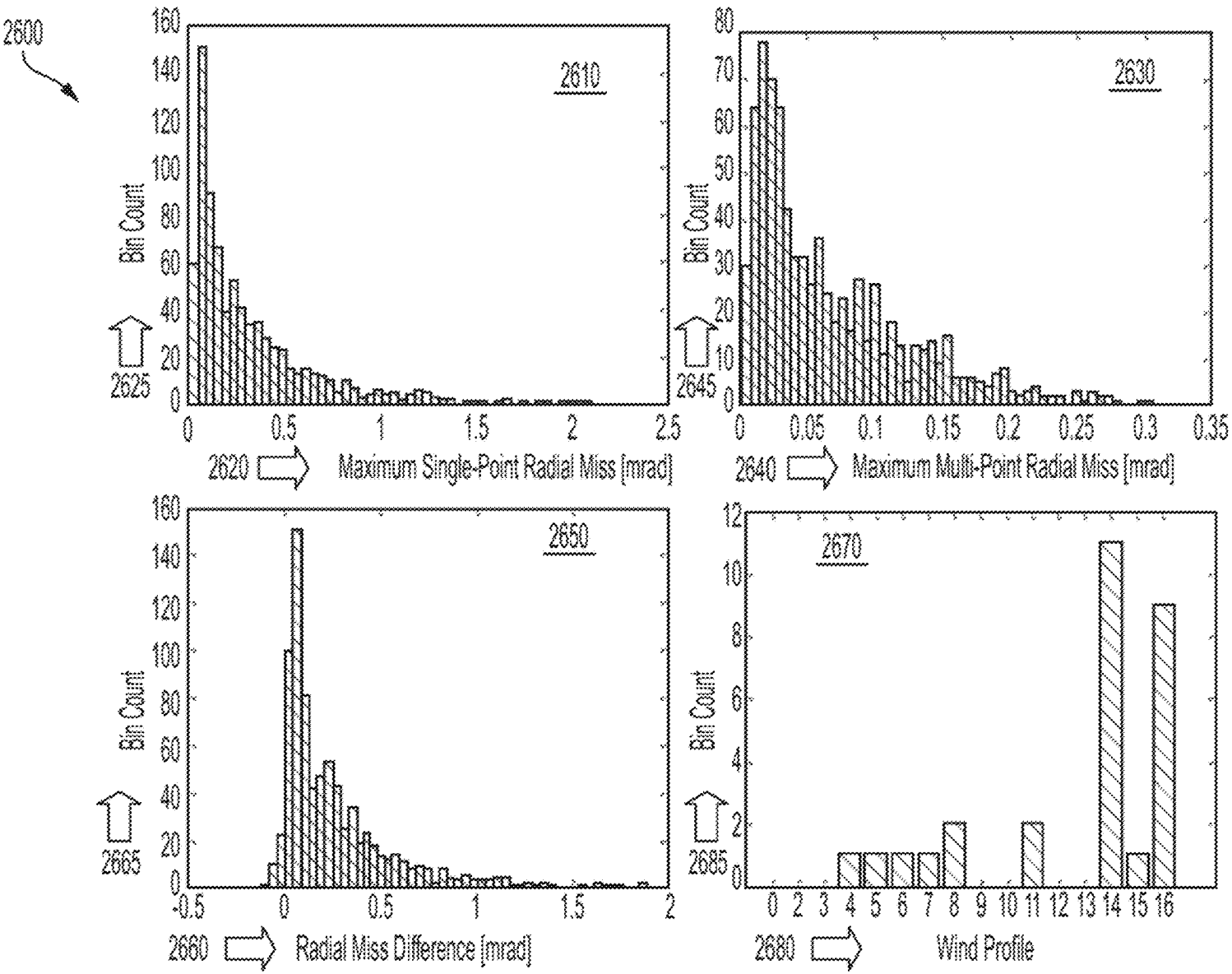
FIG. 26 is a graphical view of Radial Miss for Varying State Variables.

FIG. 26 illustrates graphical views 2600 of four plots—Single-point, Multipoint and Comparative Radial Miss Distance varying all state variables with Instances where single-point method appears more stable varying all state variables. Single-point Radial Miss Distance plot 2610 features vertical bars with maximum radial miss 2620 in milliradians (mrad) as the abscissa and bin count 2625 as the ordinate. Multipoint Radial Miss plot 2630 features vertical bars with maximum radial miss 2640 (mrad) as the abscissa and bin count 2645 as the ordinate. Difference plot 2650 features vertical bars with radial miss difference 2660 (mrad) as the abscissa and bin count 2665 as the ordinate. Instances plot 2670 features vertical bars with wind profile number 2680 as the abscissa and bin count 2685 as the ordinate.

For the single-point plot 2610 ballistic wind the radial miss distances are low, but the greatest number of data points is not at 0.0 mrad. The maximum single-point radial miss distance predicted was 2.1068 mrad. The multipoint radial miss distance plot 2630 was also not clustered at 0.0 mrad. The maximum multipoint radial miss distance predicted was 0.3069 mrad. The changing of the aircraft and gun state from the ballistic wind prediction induces less error for using a multipoint ballistic wind in plot 2630 as compared to a single-point ballistic wind in plot 2610. This is expected based on the results above in Section VI.6. A comparison of the radial miss distances in plot 2650 under the same conditions is needed to judge whether one ballistic wind method is always better than the other.

Despite the multipoint ballistic wind appearing to have a much lower radial miss distance, it might not always be better than the single-point method. The maximum radial miss distances for the multipoint ballistic wind were subtracted from the maximum radial miss distances for the single-point ballistic wind. Very few negative points exist in the comparison data in plot 2650. Differences between single-point and multipoint stability varying all state variables. This means that the multipoint ballistic wind was more often more stable relative to changes in all three state variables when compared to the single-point method. There are twenty-nine negative data points, instances where the single-point ballistic wind appears to be more stable than the multipoint ballistic wind. The largest negative magnitude was −0.1165 mrad for Wind Profile 14.

Instances plot 2650 illustrates conditions in which single-point method appears more stable varying all state variables. The largest number of instances where the single-point ballistic wind appears more stable occurred for wind profiles 14 and 16 in FIG. 16. Examining Tables 7 and 8 in respective FIGS. 23 and 24, one expects that wind profiles 14 and 16 have some instances where the single-point ballistic wind is slightly better than the multipoint method. The minimum, mean, and maximum standard deviations of the single-point ballistic wind profiles for wind profiles 14 and 16 are all low in comparison to the other wind profiles. This indicates that the single-point method did better at fitting wind profiles 14 and 16 than the others.

Section VI.8—Gun System Implementation: Correction of ballistic trajectory from wind displacement includes incorporation into a projectile launching gun system. To this effect, instrumentation and response devices can be adjusted to achieve this benefit.

Figure 27:
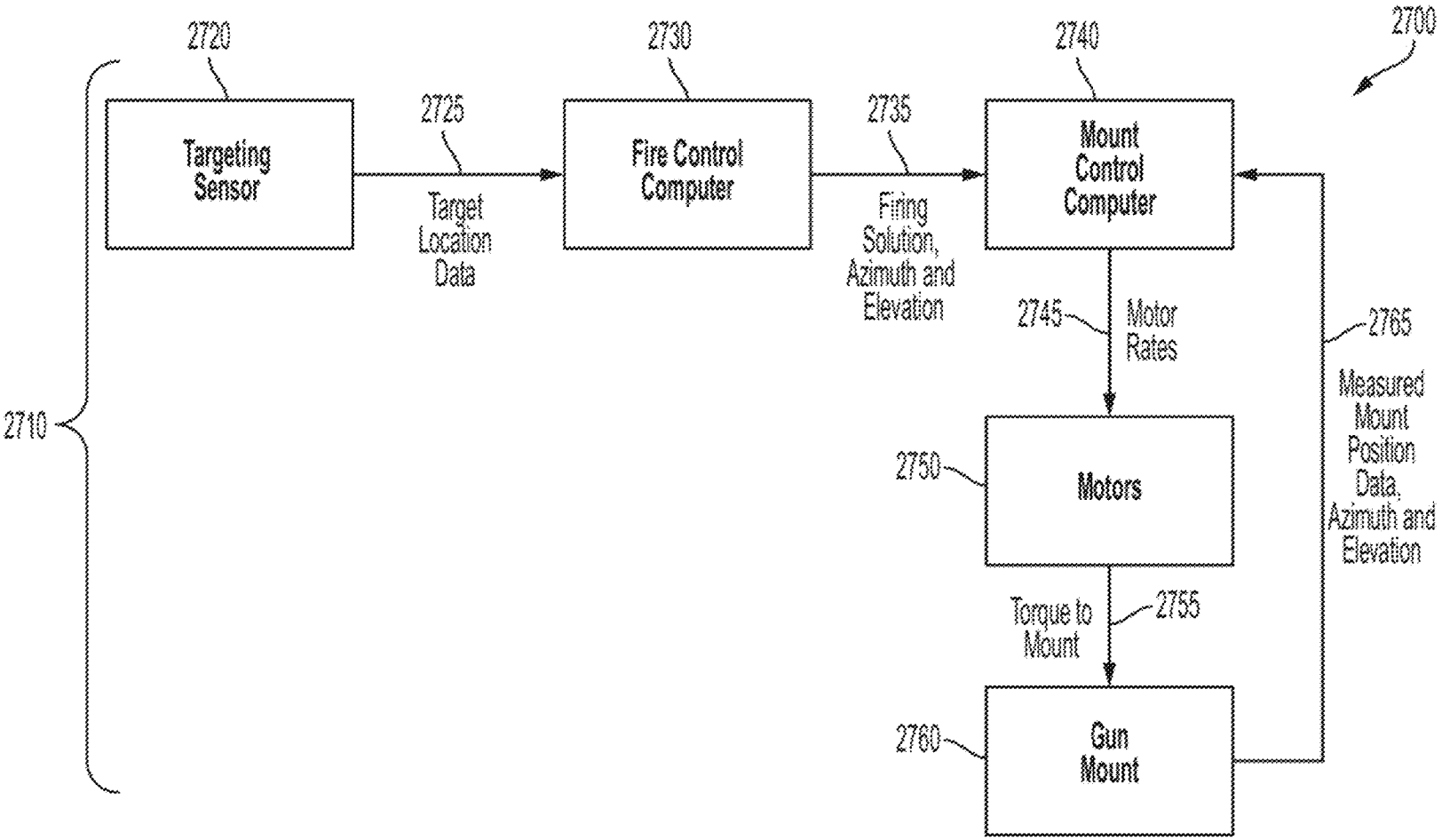
FIG. 27 Related Art
FIG. 27 is a flowchart view of a conventional gun weapon System Architecture.

FIG. 27 illustrates a flowchart view 2700 of a conventional gun weapon System Architecture 2710. A targeting sensor 2720 provides target location data 2725 to a fire control computer 2730 for target aiming. The computer 2730 in turn provides a firing solution 2735 of azimuth and elevation to a mount control computer 2740 for adjusting pointing orientation of a gun. The computer 2740 provides motor rates 2745 for operating motors 2750 to impose torque 2755 to a gun mount 2760. The computer 2740 receives feedback 2765 of the measured mount position data, azimuth and elevation from the gun mount 2760 for correcting the gun's aim.

Figure 28:
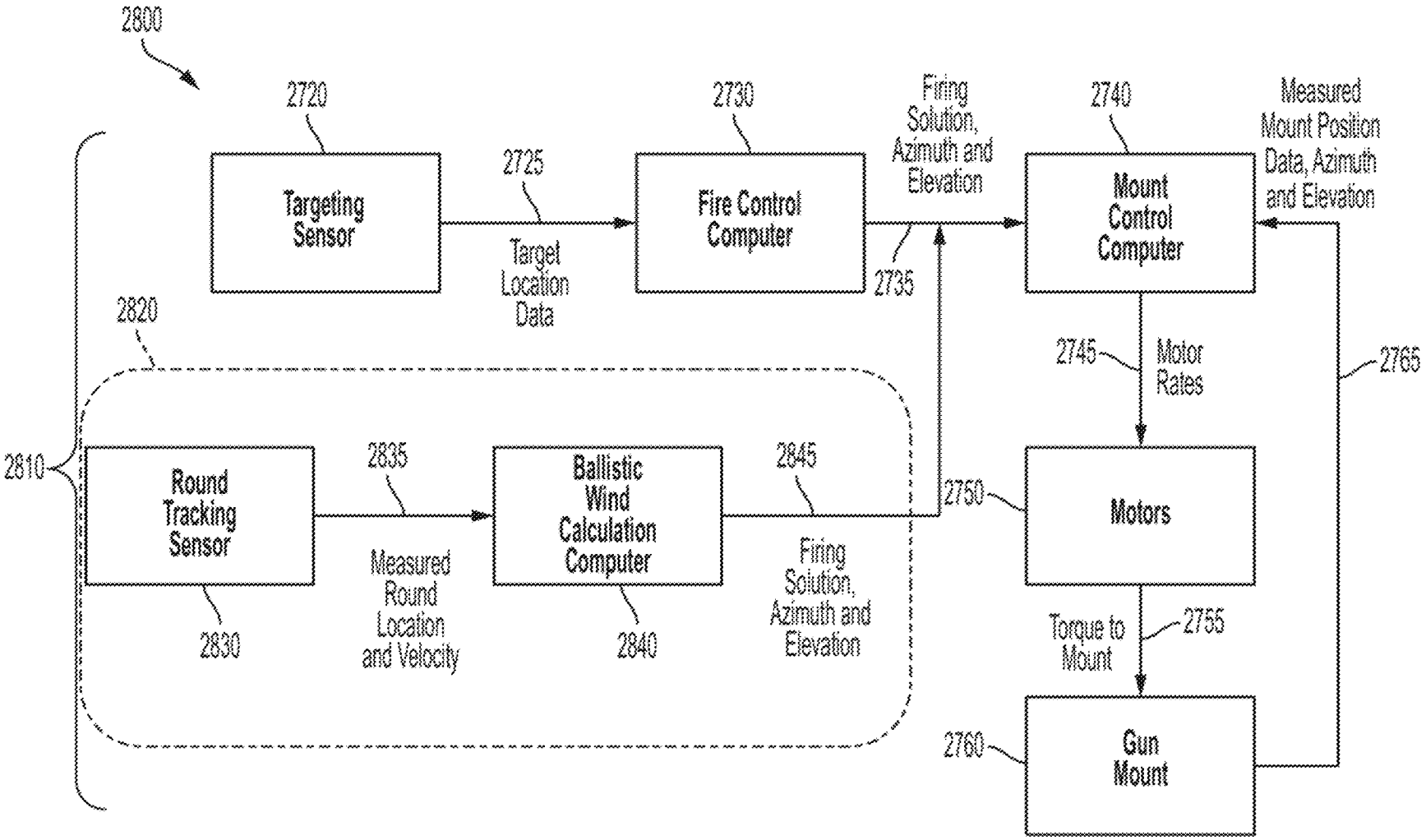
FIG. 28 is a flowchart view of an exemplary gun weapon System Architecture.

FIG. 28 illustrates a flowchart view 2800 of an exemplary gun weapon System Architecture 2810 that incorporates the benefits provided by the claimed wind correction technique. The exemplary Architecture 2810 incorporates the hardware components and processes of the conventional Architecture 2710, but also including an exemplary wind adjustment module 2820. This includes a round tracking sensor 2830 for determining bullet trajectories for rounds fired from the gun, and submits 2835 measured round location and velocity to a ballistic wind calculation computer 2840, which provides firing solution adjustment, azimuth and elevation 2845 to the mount control computer 2740 for fine-tuning the torque 2755 applied by the motors 2750 to the gun mount 2760, thereby improving accuracy in firing at the acquired target.

Section VI.9—Summary: In this section, a method of multipoint wind predictions was proposed and tested. With very few data points, the multipoint method can generate a wind prediction that closely matches the measured winds applied to the round. By analyzing the standard deviation of the differences between the measured winds and the two ballistic wind profiles, the closeness of the ballistic wind to the actual winds can be calculated. The results indicate that the multipoint ballistic wind more closely fit the measured wind profiles than the single-point ballistic wind.

The two ballistic wind methods were also tested under changing initial state of the aircraft and gun. This ballistic wind, whether a single-point and multipoint ballistic wind, is tuned based on the state of the gun and aircraft at the time of fire. Anything that changes the state of the system may invalidate the ballistic wind profile. Using the ballistic wind in a different state may lead the ballistic model to predict an impact that does not match the impact using the true winds. Ideally, a ballistic wind would be insensitive to changes in state. A simulation was run to test the radial miss distance induced by changing the state of the aircraft and gun from the state when the ballistic wind was generated.

The results showed that the multipoint ballistic wind was able to accept a change in the aircraft and gun state and maintain a lower maximum radial miss distance than the single-point ballistic wind. The multipoint ballistic wind did not always have the lower radial miss distance, however. There were instances where the single-point ballistic wind appeared to perform better under changing states, though the difference in the maximum radial miss distance between the two methods in these few instances was small.

Overall, the multipoint ballistic wind performed better than the single-point ballistic wind. For the data collected, the largest multipoint miss distance induced was 0.3069 mrad. The largest single-point miss distance induced was 2.1068 mrad. The data indicate that a multipoint ballistic wind based only on ten tracked points of the round in flight enables a more consistent impact prediction as the aircraft and gun state changes than the single-point ballistic wind.

Chapter VII—Conclusion: A successful method of making multipoint ballistic wind predictions was developed and tested as part of this research. The multipoint prediction method presented in this disclosure is based on a repetition of the single-point wind prediction between all available tracked locations of the round. The single-point wind prediction method is itself based on a bisecting search, a relatively simple search algorithm used to find an optimal value to minimize an error metric. The multipoint wind prediction method being a series of bisecting searches renders the programming of the algorithm easier and less prone to errors, indicating utility for tactical applications. The multipoint prediction method can predict ballistic winds that closely fitted the true measured winds using few data points for the tracked round, only ten points along the flight path and the initial firing conditions. The multipoint wind predictions are all much closer to the measured winds applied the round than the same single-point wind predictions. This result may seem trivial, but recall that the use of a ballistic wind does not require that it match the underlying real winds acting on the tracked round. The ballistic wind only has to cover for the physical effects on the round.

One can assume and hope that the multipoint ballistic winds closely match the underlying measured winds. The analysis of the fit of both ballistic wind models to the true winds showed that the multipoint more closely matched the true winds in all cases. Testing the stability of the single-point and multipoint wind models showed that the multipoint wind was almost always the more stable method. Changing the aircraft and gun state had less of an effect on the accuracy of the predicted impacts when a multipoint ballistic wind was used than seen when a single-point ballistic wind was used. The highest error caused by changing state was slightly over 2.1068 mrad using a single-point ballistic wind. The highest using a multipoint ballistic wind was slightly over 0.3069 mrad. This is within the manufacturers stated dispersion of the ammunition used in this simulation, meaning that this extra miss distance due to changing state is not likely to be discernable given the imprecision of the round itself. For some of the wind profiles used, a few simulation runs indicated that the single-point ballistic wind would be more stable than the multipoint ballistic wind.

Out of eight-hundred runs, only twenty-nine of them showed that the single-point ballistic wind was more stable. The slight improvement on the stability metric with the single-point, 0.1165 mrad better than the multipoint, is also well below the nominal dispersion of the round type. Further investigation of the instances where the single-point method was more stable revealed that the stability was due to the almost static nature of the measured wind profiles being tested. Wind Profiles 14 and 16 had very low wind speeds in both the East and North directions and the wind speeds in one of the directions had a clear average trend with small variations off therefrom. This is the ideal case for the single-point ballistic wind.

Examining the standard deviation values calculated as a closeness of fit of the single-point ballistic wind to the true winds, Tables 7 and 8 in FIGS. 23 and 24, wind profiles 14 and 16 have a very low standard deviation when compared to the other wind profiles, meaning that the single-point ballistic wind model was able to fit those winds more closely than the other wind profiles. None of this invalidates or reduces the usefulness of the multipoint ballistic wind. The slight improvement using the single-point ballistic wind is within the dispersion of the round. The results point to the fact that under a roughly static set of wind speeds, both the single-point and multipoint methods should converge towards each other.

Chapter VII—Epilogue: Expectations and Future Research may augment the previous analysis from wind measurements.

Section VII.1—Secondary Results: The relationship between the radial wind error and the time of flight was unexpected, though this makes sense on further review. As observed in eqn. (16), the lower the time of flight the higher the maximum radial error in the wind prediction can be off of the true wind. The predicted ballistic wind is still expected to correct the round's impact to be within the closure tolerance on the wind prediction model's search, but the actual value of the predicted wind can be wrong. At lower times of flight, the error can be larger because the wind does not have as much time to influence the flight of the round. At longer times of flight, the radial error must be lower to achieve the same closure tolerance because the wind has a longer time to act on the round.

Another secondary result of note is that changes to the total gun elevation are strong contributors to the instability of the ballistic wind predictions. In light of the relationship shown in eqn. (16), this result is not surprising. Changing the elevation has a large effect on the time of flight of the round. Small errors in the ballistic winds can lead to large miss distances by simply changing the elevation of the gun. Also of note is that the multipoint wind prediction was able to do so well with only ten points along the path of the projectile. Even at higher altitudes maximum distance between the data points, the multipoint wind prediction model could generate a ballistic wind demonstrated to be more stable than the single-point method.

Section VII.2—Future Research: The research in this disclosure shows the possible benefits to be gained by using a round racking sensor as part of an FC system. The data can be used to model the winds accurately and in a stable manner as the aircraft state changes. Increasing the fidelity of the simulation could provide better indications of the total possible improvements that could be seen from using a round tracking sensor to predict the ballistic winds.

Section VII.2.1—Full Fire-Control Simulation: This exemplary analysis assumed that a full simulation of an FC 290 was not needed and that a ballistics model 260 would suffice. This constitutes a valid assumption to limit the complexity of the system for simulation while leaving some questions unanswered. This analysis had a target determined by randomly selected gun pointing angle and aircraft state to ascertain the effect multipoint wind prediction model would have on these pointing angles? An assumption was made that the winds would cause a round to miss a target, and that modeling the winds would enable the round to hit the target. In reality, the target exists external to the FC 290 and is not determined by the gun or aircraft state. The gun and aircraft states 215 and 225 are calculated by the FC 290 to engage that target. Winds are used as part of the calculation of the gun pointing angles by the FC 290. By predicting and using a ballistic wind in the FC 290 and by changing the state of the aircraft 225 relative to the target, the gun pointing angles change to bring the round back on target.

Section VII.2.2—Full Pylon Turn Orbits: The analysis assumed that the orbit of the aircraft 310 was sufficiently modeled by a stationary aircraft at the time of fire. This makes the target static relative to the aircraft, which isn't always the case. This also causes the gun to fire the same way into the winds for each shot simulated. In reality, the aircraft 310 is orbiting a path 110. This causes a target to change location relative to the aircraft 310 unless perfectly aligned with center 120 in orbit path 110. Changing target location alters the gun elevation over time. As seen in Chapter VI, changing the state of the aircraft and gun can have an effect on the possible errors in impacts that result from using ballistic wind predictions. Investigating the effect of full pylon turns combined with a full model of the FC 290 can provide a good indication of whether the multipoint ballistic wind model introduces any instabilities to the gun pointing angles at the time of flight of the round changes in different parts of the orbit.

Section VII.2.3—More Tracked Data Points: The exemplary analysis assumes that the round tracking sensor provides ten data points along the flight path of the round. This is a very low value. What are the benefits of adding more values? Or, conversely, what is the effect of having fewer values?A parametric analysis of the number of data points required to achieve a certain level of stability would help to inform future work into developing the necessary hardware and software to integrate a round tracking sensor.

Section VII.2.4—Combined Errors: Other errors are neglected for this analysis. In a real system, these errors would manifest themselves and complicate the wind prediction. These errors would have to be sorted and minimized in their specific frames of reference to enable the correction of the world-relative errors with a ballistic wind prediction. A fuller simulation that accounts for the platform relative errors, such as sensor and gun misalignment, errors in the ammunition description, and limitations in ballistics modeling, could reveal possible complications for a round tracking sensor integrated into the FC 190 of an aircraft 310. Any method for decoupling errors into their proper frames of reference entails uncertainties that can affect the ability of the multipoint wind prediction model to properly close on the ballistic wind.

Section VII.2.5—Wind Vector Field: This disclosure shows the possibility of correctly predicting a ballistic wind profile that closely matches the underlying winds. These ballistic wind profiles can be used to correct wind errors in subsequent firings. These winds are only valid for the round used to predict them, however, and may not be the best ballistic wind to apply to later rounds. The validity of the ballistic wind depends on the variations of the true winds over both time and space. The winds that are acting at one location in the orbit may not be representative of the winds acting at other locations. Further, the true winds are expected to vary over time, possibly reducing the usefulness of the winds predicted at any location in the orbit. This research presents an opportunity to research the creation of a model of a wind vector field that covers the entire orbit Combining the individual ballistic winds may be possible to describe not only the winds at a single location in the orbit but around the entire orbit. Such a model could enable accurate predictions of the ballistic winds as they change over time. A change in the ballistic winds at one location in the orbit from an earlier ballistic wind could be used to predict a change in the ballistic winds at other locations in the orbit.

Section VII.2.6—Tuning Ballistic Model: The prediction of a multipoint ballistic wind enables the tuning of the ballistics model 260 for different round types. A ballistics model 260 can be poorly calibrated for the round type being fired and still enable a usable prediction of the round's flight. Calibrating or tuning, the model requires a source of truth data to compare the model against. A multipoint ballistic wind can be used as the truth data, enabling improved calibration of the ballistics model 260 for all round types. The process of calibrating would require making multipoint ballistic wind predictions for multiple round types at the same time. One can then be selected as the correct wind prediction and the form factors and aeroballistic coefficients of the other rounds could be adjusted to make the ballistic wind predictions match the correct wind.

Were a separate device capable of measuring the true winds, then the ballistics model 260 could be tuned for each round type using the true winds as the truth data. The tuning of the ballistics model 260 made possible by this result is required for the ballistic wind prediction of a given round type to be applied to other ammunition. Without tuning, the ballistic winds predicted for each round varies from the true winds due to poor modeling. The result of this disclosure coupled with measuring the true winds enables tuning of the form factors on the ballistic model 260. Better tuning of the ballistics model 260 enables for more accurate prediction of the flight path of the round, which may improve overall accuracy of the FC 190.

Section VII.2.7—Tactical Application: Perhaps the most obvious research opportunity for the results of this disclosure is to apply the corrections in an FC 190 in a representative tactical environment. At this point, a viable algorithm has been identified and indications are that a ballistic wind, which closely fits the true winds can be predicted. A practical demonstration is possible as long as the hardware is available to support the data required, namely a round tracking sensor. The other research ideas presented above are all interesting modeling questions and topics that should be investigated to better understand the capabilities and limitations of a multipoint ballistic wind. A practical implementation may reveal that the benefits gained through the above research are not worth the effort of the research itself.

Terms Glossary: The following terms are defined herein.

Aleatory error: Those errors in a calculation or simulation that result from factors and effects that could not possibly be known at the time of calculation. Example would be the initial velocity of a projectile. An average initial velocity is used in the modeling, but the exact velocity cannot be known until the round is fired, at which point it is too late to account for the actual initial velocity.

Epistemic error: Those errors in a calculation or simulation result caused by a lack of knowledge of a factor that could have been known and better measured before the calculation and accounted for. Example would be accounting for the exact mass of a projectile. One can measure each round, but in practice a single mass is assumed to be correct for all rounds of a given type.

Firing-Solution: A set of gun azimuth and elevation pointing angles the gun must be pointed at for a round fired by the gun to impact an intended target.

Flyout or ballistic flyout: The result of a single run of the ballistics model.

Nominals: Flight parameters that determine the geometry of a pylon turn. Parameters include altitude above target, bank angle, and airspeed.

No-wind impact: That predicted impact location generated by the ballistics model 260 that has no winds applied to the round in flight.

Pylon turn: A flight maneuver wherein a pilot holds a constant bank angle and airspeed causing the aircraft to fly in a circle of constant altitude around a specified center location.

Round: A single projectile or type of projectile. This is used interchangeably with ammo, ammunition, and projectile.

Slant Range: The total linear distance between the initial location of a projectile and its final impact location.

Tweak: A set of calculated values used to correct for unknown factors causing shots fired to impact off the intended target. Also known as "Kentucky Windage."

Wind Column: A measure of the East and North wind speeds indexed by the altitude. Also called the wind profile.

Winded Impact: That predicted impact location generated by the ballistics model 260 that has a wind model applied to the round in flight. Expected to show a wind induced offset from the no-wind impact.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A computer-implemented wind correction method on a fire-control processor operated by a gun aiming system on an aircraft for a projectile launching gun aiming at a target, said method for said processor comprising instructions for:

obtaining first physical parameters for wind column, gun state, ammunition type and aircraft flight conditions;

executing a ballistics model to obtain a flight path of the projectile based on said first physical parameters;

obtaining number of points for wind direction and velocity across altitudes;

executing a tracker model to obtain tracker location and initial gun state based on said number of points and said flight path;

obtaining closure tolerance and cross-correlation factor;

modeling wind prediction based on said closure tolerance, said cross-correlation factor, said tracker location and said initial gun state to obtain a predicted wind column;

incorporating said predicted wind column for wind column prediction for a projectile effect; and applying said projectile effect to the fire-control processor to adjust aiming the gun.

2. The method according to claim 1, wherein said aircraft flight conditions include attitude, bank angle and speed of the aircraft.

3. The method according to claim 1, further including:

obtaining type, speed and direction of wind; and executing a wind model to obtain said wind column based on said wind type, said wind speed and said wind direction.

4. The method according to claim 1, further including:

obtaining attitude, bank angle and speed of the aircraft; and executing an aircraft model to obtain aircraft flight conditions based on said attitude, said bank angle and said speed of the aircraft.

5. The method according to claim 1, wherein said wind direction and velocity are obtained from multiple measurements.

6. The method according to claim 1, wherein said wind direction and velocity are obtained from a single-point measurement.

* * * * *